US011994001B2

(12) United States Patent
Olsen

(10) Patent No.: US 11,994,001 B2
(45) Date of Patent: May 28, 2024

(54) DOWNHOLE METHOD FOR SEPARATING WELL TUBULAR STRUCTURE

(71) Applicant: Welltec A/S, Allerød (DK)

(72) Inventor: Jacob Bay Olsen, Allerød (DK)

(73) Assignee: Welltec A/S, Allerød (DK)

( * ) Notice: Subject to any disclaimer, the term of this patent is extended or adjusted under 35 U.S.C. 154(b) by 0 days.

(21) Appl. No.: 17/742,224

(22) Filed: May 11, 2022

(65) Prior Publication Data

US 2022/0364434 A1 Nov. 17, 2022

(30) Foreign Application Priority Data

May 12, 2021 (EP) ..... 21173677
May 27, 2021 (EP) ..... 21176239

(51) Int. Cl.
*E21B 33/16* (2006.01)

(52) U.S. Cl.
CPC ..... *E21B 33/16* (2013.01)

(58) Field of Classification Search
CPC ..... E21B 33/13; E21B 33/16; E21B 29/002; E21B 29/005
See application file for complete search history.

(56) References Cited

U.S. PATENT DOCUMENTS 6,435,281 B1 * 8/2002 Baugh ..... E21B 19/22 166/207
6,478,088 B1 11/2002 Hansen et al.
11,299,948 B2 * 4/2022 Krüger ..... E21B 29/08
2011/0000668 A1 * 1/2011 Tunget ..... E21B 29/06 166/387
2017/0051585 A1 * 2/2017 Hazel ..... E21B 23/06
2018/0100373 A1 * 4/2018 Krüger ..... E21B 47/005
2018/0106124 A1 * 4/2018 Hazel ..... E21B 29/00
2018/0135372 A1 5/2018 Degeare et al.
2018/0258735 A1 * 9/2018 Shafer ..... E21B 29/002
2019/0003280 A1 * 1/2019 Witt ..... E21B 33/13
2019/0178049 A1 * 6/2019 Kræmer ..... E21B 33/134
2019/0330949 A1 * 10/2019 Krüger ..... E21B 29/005
2020/0072009 A1 3/2020 Fairweather
(Continued)

FOREIGN PATENT DOCUMENTS

GB 2569566 6/2019

OTHER PUBLICATIONS

Extended European Search Report for EP Application No. 21176239.8 dated Nov. 10, 2021, 9 pages.

*Primary Examiner* — David Carroll
(74) *Attorney, Agent, or Firm* — Nixon & Vanderhye P.C.

(57) ABSTRACT

A downhole method for preparing and/or providing isolation at a predetermined position in an existing well includes inserting a downhole tool comprising a bit on a projection part in a first well tubular metal structure, positioning the downhole tool opposite the predetermined position, separating an upper part of the first well tubular metal structure from a lower part of the first well tubular metal structure, moving the downhole tool along the longitudinal extension in the upper part to a second position, and separating a first part of the upper part of the first well tubular metal structure from a second part of the upper part of the first well tubular metal structure, thus providing an uncased opening between the second part of the first section and the second section.

18 Claims, 17 Drawing Sheets

(56) References Cited

U.S. PATENT DOCUMENTS

Figure 1A:
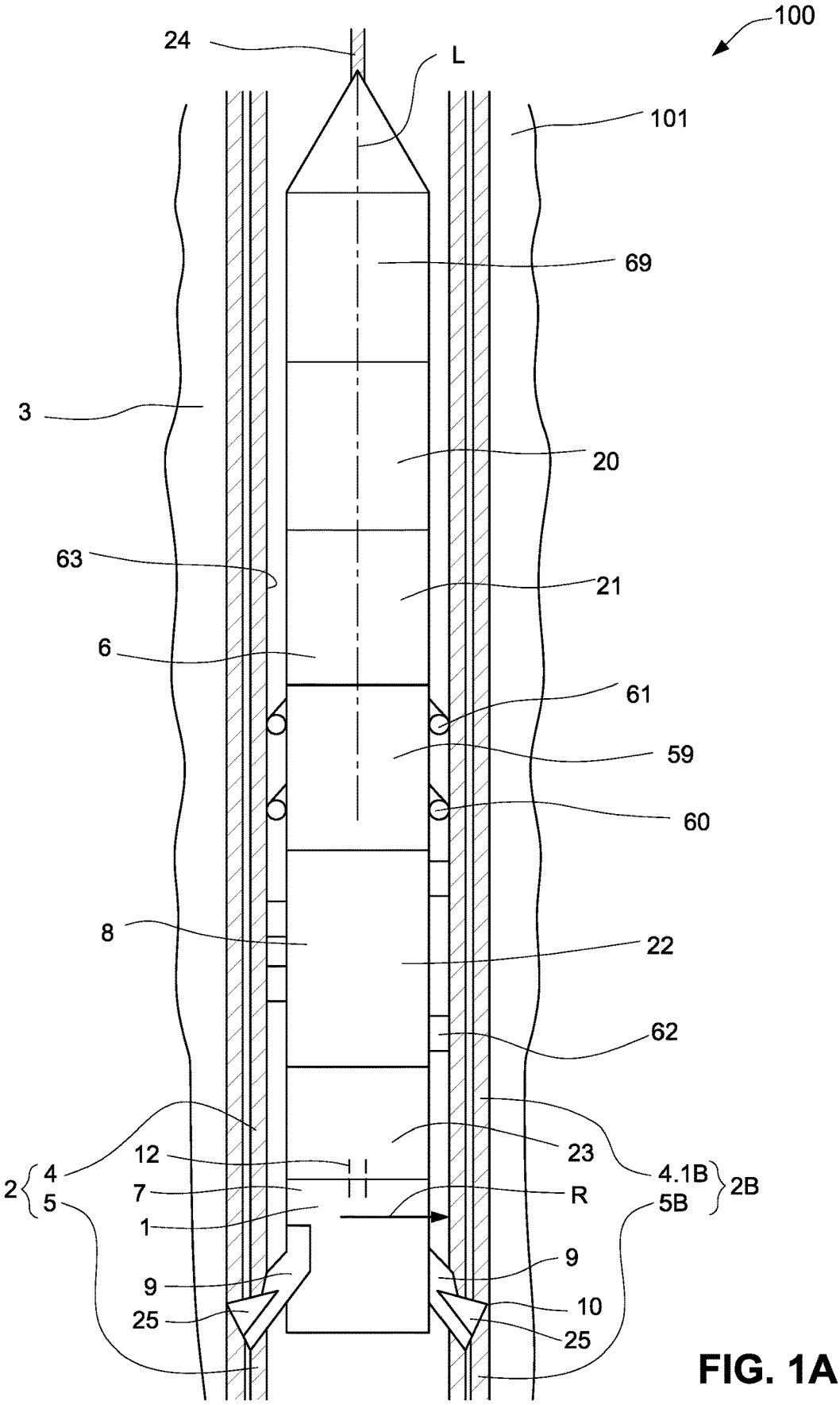

| | | | | |
|---|---|---|---|---|
| 2020/0217159 | A1* | 7/2020 | Krüger | E21B 33/138 |
| 2020/0217170 | A1* | 7/2020 | Krüger | E21B 33/1277 |
| 2020/0232295 | A1* | 7/2020 | Telfer | E21B 17/07 |
| 2021/0246748 | A1* | 8/2021 | Delgado | E21B 29/005 |

* cited by examiner

DOWNHOLE METHOD FOR SEPARATING WELL TUBULAR STRUCTURE

This application claims priority to EP Patent Application No. 21173677.2 filed May 12, 2021, and EP Patent Application No. 21176239.8 filed May 27, 2021, the entire contents of which are hereby incorporated by reference.

The present invention relates to a downhole method for preparing and/or providing isolation at a predetermined position in an existing well having a top and a first well tubular metal structure arranged in a wellbore, the first well tubular metal structure having a longitudinal extension. The invention also relates to a downhole system for performing the downhole method.

In Australia and Brazil, existing wells do not perform as intended and the production of hydrocarbon-containing fluid consequently dwindles from a specific well, or a well produces a high content of water, it is necessary for the operator to abandon the well in a safe way, which is to remove the inner production string to create access before cementing. However, in some of these wells, the inner production string is surrounded by an outer production string, i.e. the completion is double-cased, and a control line or hydraulic tube may run on the outside of the inner production string. Both the inner and outer production strings need to be at least partly removed in order for the cement to gain access, and if a control line is present, the line needs to be removed as well since fluid may flow along the line in the cement and cause a leak. In order for the cement to gain access, the inner production string is pulled out and so is the control line as it is clamped to the inner production string, and subsequently the outer production string is pulled out and cement is poured down, filling up at least 30 metres of the well above a plug. This is an expensive operation as a big rig is required for pulling out such production strings.

It is an object of the present invention to wholly or partly overcome the above disadvantages and drawbacks of the prior art. More specifically, it is an object to provide an improved downhole method capable of providing abandonment of the well in a simpler, less expensive and regulatorily compliant manner.

The above objects, together with numerous other objects, advantages and features, which will become evident from the below description, are accomplished by a solution in accordance with the present invention by a downhole method for preparing and/or providing isolation at a predetermined position in an existing well having a top and a first well tubular metal structure arranged in a wellbore, the first well tubular metal structure having a longitudinal extension, comprising:

- inserting a downhole tool comprising a bit on a projection part in the first well tubular metal structure,
- positioning the downhole tool opposite the predetermined position,
- separating a first section/upper part of the first well tubular metal structure from a second section/lower part of the first well tubular metal structure by machining into and along a circumference of the first well tubular metal structure,
- moving the downhole tool a predetermined distance along the longitudinal extension in the first section of the first well tubular metal structure to a second position above the predetermined position, and
- separating a first part of the first section of the first well tubular metal structure from a second part of the first section of the first well tubular metal structure by machining into and along a circumference of the first well tubular metal structure, providing an uncased opening between the second part of the first section and the second section.

Furthermore, the downhole method may further comprise leaving the first part of the first section of the first well tubular metal structure in the well.

By the leaving the cut out first part of the first section of the first well tubular metal structure in the well, the uncased opening can be made anywhere in the well without spending time on taking the upper of the well tubular metal structure out the well first nor this first part of out the well. Thus, this method provides a much faster way of plugging and abandoning a well and this method also provides a much cheaper way of plugging and abandoning the well. Especially the cost is very important as when making the well, i.e. drilling the borehole, completing the well etc., the operator has to deposit money for the plugging and abandoning the well in the event that the operator does not have the funds to do so when needed many years later. Therefore, if the operator can present a plugging and abandoning method which cost less than conventional methods, the operator can reduce the deposit amount accordingly. Conventional method pulls out the part of the completion/well tubular metal structure being above the position where the barrier is to be set and thus spends a lot of money in doing so.

Moreover, the downhole method may further comprise:

- inserting a barrier, such as an annular barrier or a plug, in the uncased opening between the first section and the second section for providing isolation in the wellbore isolating an upper part of the wellbore from a lower part of the wellbore.

Further, the downhole method may also comprise:

- expanding the barrier for providing isolation at the predetermined position.

Also, the downhole method may further comprise pouring cement in the upper part onto the barrier and through the uncased opening.

In addition, separating the first section from the second section may comprise machining part of the first well tubular metal structure over a predetermined distance along the longitudinal extension.

Furthermore, the downhole method may also comprise:

- moving the downhole tool a predetermined distance along the longitudinal extension in the first section of the first well tubular metal structure to a third position above the second position, and
- separating another part of the first section of the first well tubular metal structure from a remaining part of the first section of the first well tubular metal structure by machining into and along a circumference of the first well tubular metal structure, increasing the uncased opening.

Moreover, separating the first section from the second section may comprise moving the first section away from the second section after the machining.

Further, separating the first section from the second section may comprise pulling the first section out of the borehole after the machining.

Also, separating the first section from the second section may further comprise inserting the first section in the borehole at a distance from the second section.

In addition, inserting the annular barrier may be performed by the downhole tool or another downhole tool.

Furthermore, inserting the unexpanded annular barrier may be performed by mounting the unexpanded annular barrier at an end of the first section.

Moreover, the annular barrier may comprise a tubular metal part and an expandable metal sleeve connected with and surrounding the tubular metal part, providing an annular space between the tubular metal structure and the expandable metal sleeve, the tubular metal part having an expansion opening.

Additionally, the tubular metal part may have a closed end furthest away from the top of the well.

Furthermore, the tubular metal part may have ball seat for receiving a ball before pouring of cement.

Further, the annular barrier may comprise an expandable metal sleeve.

Also, a control line or hydraulic tube may extend along the longitudinal extension outside the first well tubular metal structure, and the step of separating a first section of the first well tubular metal structure from a second section may further comprise separating a first part of the control line or hydraulic tube from a second part of the control line or hydraulic tube.

In addition, a second well tubular metal structure may be arranged circumferentially to the first well tubular metal structure, and the step of separating a first section of the first well tubular metal structure from a second section may further comprise separating a first section of the second well tubular metal structure from a second section of the second well tubular metal structure by machining into and along a circumference of the second well tubular metal structure.

Furthermore, a second well tubular metal structure may be arranged circumferentially to the first well tubular metal structure, and the control line or hydraulic tube may be arranged between the first well tubular metal structure and the second well tubular metal structure, the step of separating a first section of the first well tubular metal structure from a second section further comprises separating a first section of the second well tubular metal structure from a second section of the second well tubular metal structure by machining into and along a circumference of the second well tubular metal structure.

Moreover, the step of separating the first and/or second part may be initiated to machining into and along a circumference of the first well tubular metal structure, subsequently stopping the machining when the first and/or second part is separated.

In addition, the downhole tool (machining) may be stopped or deactivated prior to moving the downhole tool a predetermined distance along the longitudinal extension above the predetermined position.

Furthermore, the predetermined position may be a first determined position, the "separating a first part of the first section of the first well tubular metal structure from a second part of the first section of the first well tubular metal structure" being performed at a second predetermined position, and the downhole tool being inactive while being moved from the first predetermined position to the second predetermined position.

Additionally, the downhole tool may be stopped when one portion of the well tubular structure has been separated from a second part of the well tubular structure.

Moreover, the first part of the control line or hydraulic tube may be separated from the second part of the control line or hydraulic tube by projecting the bit on the projection part further outwards in a radial direction.

Further, the first section of the second well tubular metal structure may be separated from a second section of the second well tubular metal structure by projecting the bit on the projectable element further outwards in a radial direction.

Also, a sleeve may be arranged circumferentially to the first well tubular metal structure, and the step of separating a first section of the first well tubular metal structure from a second section may further comprise separating a first section of the sleeve from a second section of the sleeve.

In addition, expanding the annular barrier may be performed by expanding the tubular metal part and/or the expandable metal sleeve.

Furthermore, expanding the annular barrier may be performed by means of a mandrel and/or an expandable bladder.

Moreover, the expandable metal sleeve may be radially expanded between the first section and the second section to abut the wall of the borehole.

Further, the annular barrier may have a first barrier end and a second barrier end, the first barrier end being configured to overlap the first section, and the second barrier end being configured to overlap the second section.

Also, the downhole method may further comprise providing second zonal isolation at a second predetermined position in the annulus between the wall of the borehole and the well tubular metal structure.

Additionally, the invention relates to a downhole system for performing the downhole method to provide zonal isolation at a predetermined position in a borehole and another well tubular metal structure having a longitudinal extension in an existing well, comprising:

- a first well tubular metal structure arranged in the borehole,
- a downhole tool inserted in the first well tubular metal structure and positioned opposite the predetermined position for separating several first parts of a first section of the first well tubular metal structure from a second section of the first well tubular metal structure by machining into and along a circumference of the first well tubular metal structure, providing an uncased opening, and
- a barrier arranged between the first section and the second section for providing zonal isolation at the predetermined position in the uncased opening.

The present invention also relates to a downhole system for performing the downhole method according to any of the preceding claims to provide zonal isolation at a predetermined position in the borehole and another well tubular metal structure having a longitudinal extension in an existing well, comprising:

- a well tubular metal structure arranged in the borehole,
- a downhole tool being a downhole tubing intervention tool comprising:
  - a tool housing having a first housing part and a second housing part, the first housing comprises a bit on a projection part
  - a rotation unit, such as an electric motor, for rotating the first housing part in relation to the second housing part, and
  - the tool being inserted in the well tubular metal structure and positioned opposite the predetermined position for separating several first parts of a first section of the well tubular metal structure from a second section of the well tubular metal structure by machining into and along a circumference of the well tubular metal structure by rotating the first housing part and thereby the bit, providing an uncased opening, and
- a barrier arranged between the first section and the second section for providing zonal isolation at the predetermined position in the uncased opening.

Moreover, the bit may comprise a first segment of abrasive material.

In addition, the bit may be movable between a retracted position and a projected position in relation to the first housing part of the tool housing.

The downhole tool may be a downhole tubing intervention tool for submerging into a casing in a wellbore and for selectively removing material from within the casing, the tool extending in a longitudinal direction, comprising:

- a tool housing having a first housing part and a second housing part,
- a rotation unit, such as an electric motor, arranged in the second housing part, and
- a rotatable shaft rotated by the rotation unit for rotating at least a first segment of abrasive material being connected with the first housing part and forming an abrasive edge, wherein the first segment is movable between a retracted position and a projected position in relation to the first housing part of the tool housing.

When having large-diameter wells and the outer diameter of the tool is restricted by a restriction further up the casing than where the operation is to take place, the segment needs to be projected further out than in small-diameter casings, and then there will be a high risk that vibrations will knock off pieces of the segment during the machining operation for removing material, but when the segment is made of abrasive material, new grains come forward, and the removal operation can proceed.

In other situations, the downhole tubing intervention tool is submerged into a casing which is surrounded by a sleeve or a second casing, and the downhole tubing intervention tool needs to selectively remove material from within the casing to separate both the casing and the sleeve or the second casing. This is not possible if the separation of the first casing destroys the segment as the segment then cannot separate the second casing or the sleeve. However, when the segment is of an abrasive material which, when worn, merely reduces in size and new particles in the segment are exposed, the separation operation can easily proceed with success as the segment is merely projected a bit further for compensating for the reduced size of the segment.

Thus, the segment may be an abrasive segment.

Furthermore, the segment may be a grinding segment.

Also, the segment may be a grinding stone.

Additionally, the first segment of abrasive material may be a non-chip-producing material.

Further, the first segment may be made of a non-chip-producing material.

The first segment may be hydraulically movable between a retracted position and a projected position in relation to the first housing part of the tool housing.

By having a hydraulically operated part activation assembly, the segment can be projected continuously outwards as the segment is worn so that the size-reduced segment is still able to contact the casing, thus continuing the removal operation.

In addition, the tool may further comprise a gear section arranged between the rotation unit and the first housing part.

Moreover, the at least first segment of abrasive material may comprise grains of diamond or Cubic Boron Nitride, aluminium oxide (corundum), silicon carbide, tungsten carbide or ceramic.

Further, the downhole tubing intervention tool may comprise a second segment arranged at a distance from the first segment along a circumference of the tool.

Also, the at least first segment of abrasive material may comprise a binder, such as iron, cobalt, nickel, bronze, brass, tungsten carbide, ceramic, resin, epoxy or polyester.

Furthermore, the first segment may have a base part and a projection part projecting from the base part, forming a radial tip.

In operation, the radial tip contacts the casing for selectively removing material from the casing, e.g. for separating the casing, and when the segment of an abrasive material is worn during the removal operation, the projection part of the segment is merely reduced in size, and new particles in the segment are exposed. Thus, the separation operation can easily proceed with success as the remaining part of the projection part of the segment is merely projected a bit further for compensating for the reduced size of the segment. When separating a sleeve or a second casing surrounding the first casing, the base part also becomes abrasive, removing further material from the first casing so that the projection part having separated the first casing can project further to also separate the second casing.

Additionally, the first segment may taper from a base part into a terminal end, forming a radial tip.

Moreover, the first segment may taper from a base part into a terminal end, forming a radial tip of the projection part.

Thus, the base part, the radial tip and the projection part may be of abrasive material.

Furthermore, the radial tip may form the abrasive edge.

In addition, the first segment may have a segment length along the longitudinal axis in the retracted position and a segment height perpendicular to the longitudinal axis, the radial tip having a tip length along the longitudinal axis being less than 75% of the segment length, preferably less than 60% of the segment length, and more preferably less than 50% of the segment length.

Further, the segment may have a first segment height at the base part and a second segment height at the radial tip, the second segment height being higher than the first segment height; preferably the second segment height is at least twice as high as the first segment height, and more preferably the second segment height is at least three times as high as the first segment height.

Moreover, the first segment may have a segment width extending along the circumference of the tool.

Furthermore, the segment width may be constant along the segment length.

Also, the segment width may be constant along the segment height.

In addition, the segment width may be smaller at the terminal end than at the base part.

Moreover, the radial tip may have a front face facing away from the second tool housing and a back face facing the second tool housing, and the front face may incline inwards from the terminal end so that the terminal end of the radial tip is the outermost part of the segment.

The segment may have a base face facing the first tool housing and facing away from the terminal end, and the segment may have an angle between the base face and the front face of more than 90°. In this way, the radial tip is more acute than if the front face did not incline inwards or backwards towards the back face.

Also, the tool may further comprise a projection part movable between a retracted position and a projected position in relation to the first housing part of the tool housing, the projection part having a first end and a second end, the second end being movably connected with the first housing part, and the first end being connected with the first segment, and the tool may further comprise a part activation assembly for moving the projection part between the retracted position and the projected position.

Moreover, the projection part may have several segments connected to the first end.

Additionally, the projection part may have a part extension, the segment length of the first segment extending along the part extension, and the segment height extending perpendicularly to the part extension in a radial direction of the tool.

Furthermore, the projection part may pivot between the retracted position and the projected position.

Also, the part activation assembly may comprise:

- a piston housing arranged in the first housing part and comprising a piston chamber, and
- a piston member arranged inside the piston chamber for moving the part between the retracted position and the projected position, the piston member being movable in the longitudinal direction of the downhole tool and having a first piston face, and the piston member being capable of applying a projecting force on the part by applying hydraulic pressure on the first piston face and moving the piston in a first direction.

By having a hydraulically operated part activation assembly, the segment can be projected continuously outwards as the segment is worn so that the size-reduced segment is still able to contact the casing with sufficient weight on bit (WOB), thus continuing the removal operation.

In addition, the part activation assembly may comprise:

- a piston housing arranged in the first housing part and comprising a piston chamber, and
- a piston member arranged inside the piston chamber for moving the projection part between the retracted position and the projected position, the piston member being movable in a direction perpendicular to the longitudinal direction of the downhole tool and having a first piston face, and the piston member being capable of applying a projecting force on the part by applying hydraulic pressure on the first piston face and moving the piston in a first direction.

Further, the downhole tubing intervention tool may be a downhole tubing separation tool separating an upper part of the casing from a lower part of the casing by abrasively machining the casing from within.

Moreover, the downhole tubing intervention tool may further comprise an anchor section comprising at least one anchor extendable from the tool housing for anchoring the tool in the casing.

In addition, the downhole tubing intervention tool may further comprise a driving unit comprising wheels on wheel arms for propelling the tool forward in the well.

Furthermore, the downhole tubing intervention tool may also comprise a stroking unit, such as a stroking tool, providing a movement of the first segment in the projected position along a longitudinal extension of the well tubular metal structure. Thus, when the downhole tubing intervention tool is submerged into the well tubular metal structure, and the anchor section of the downhole tool is hydraulically activated to anchor the non-rotating part of the downhole tubing intervention tool in relation to the well tubular metal structure, the first segment removes, e.g. by milling or grinding, material from the well tubular metal structure along the circumference and the longitudinal extension of the well tubular metal structure. Thereby, a section of the well tubular metal structure is removed from the well tubular metal structure by grinding the well tubular metal structure into small particles, creating or re-creating annular isolation.

The section removed from the well tubular metal structure may have a length along the longitudinal extension of the well tubular metal structure of more than 0.5 metre, preferably more than 1 metre, and even more preferably more than 5 metres.

Finally, the invention also relates to a downhole system comprising a first well tubular metal structure and the abovementioned downhole tubing intervention tool for arrangement in the downhole system.

The invention and its many advantages will be described in more detail below with reference to the accompanying schematic drawings, which for the purpose of illustration show some non-limiting embodiments and in which:

FIG. 1A shows a partial, cross-sectional view of a downhole tubing intervention tool in a casing/first well tubular metal structure and a second well tubular metal structure in a wellbore for separating an upper part of the first well tubular metal structure from a lower part of the first well tubular metal structure by machining of the first well tubular metal structure from within, and for separating an upper part of the second well tubular metal structure from a lower part of the second well tubular metal structure.

Figure 1B:
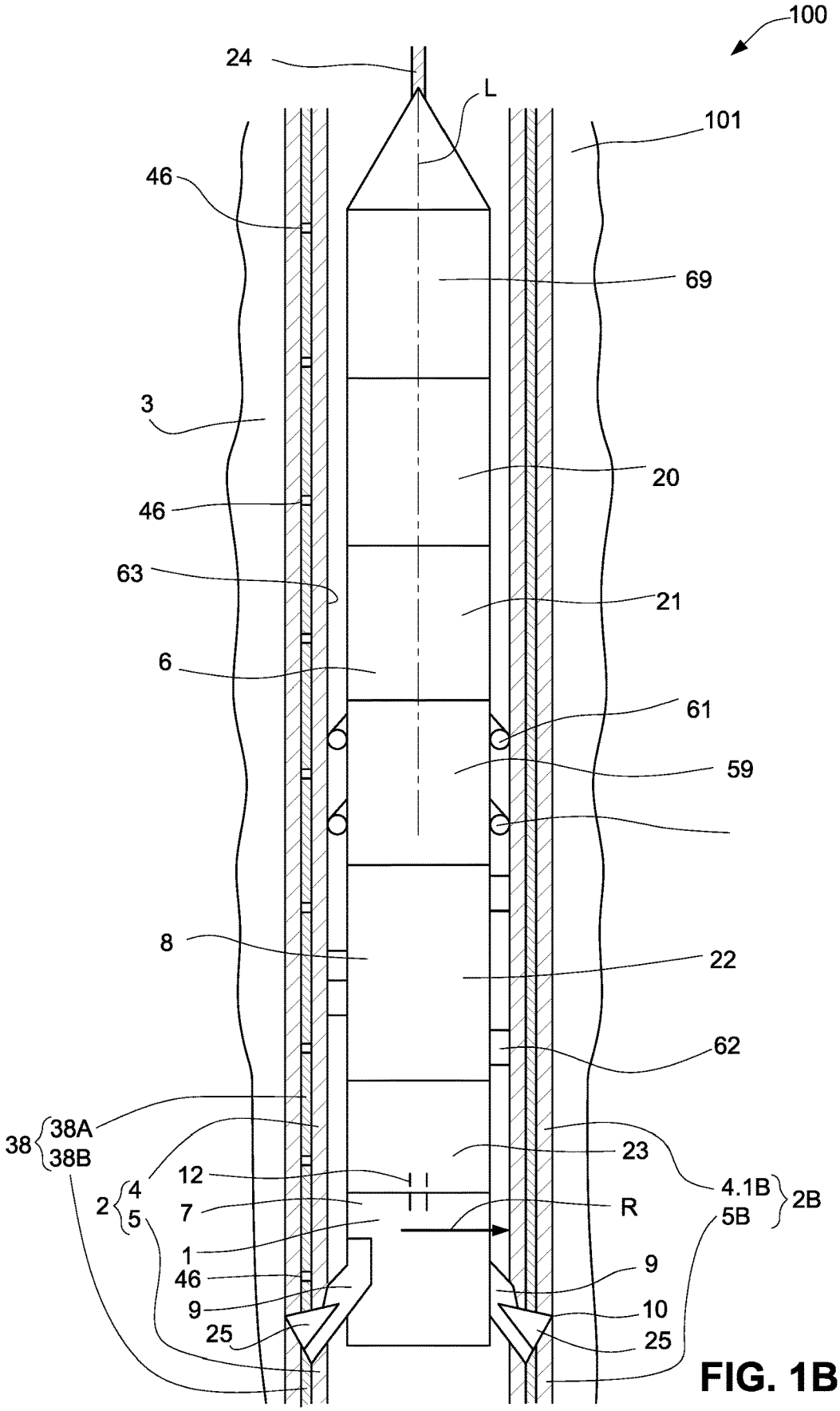
Figure 2:
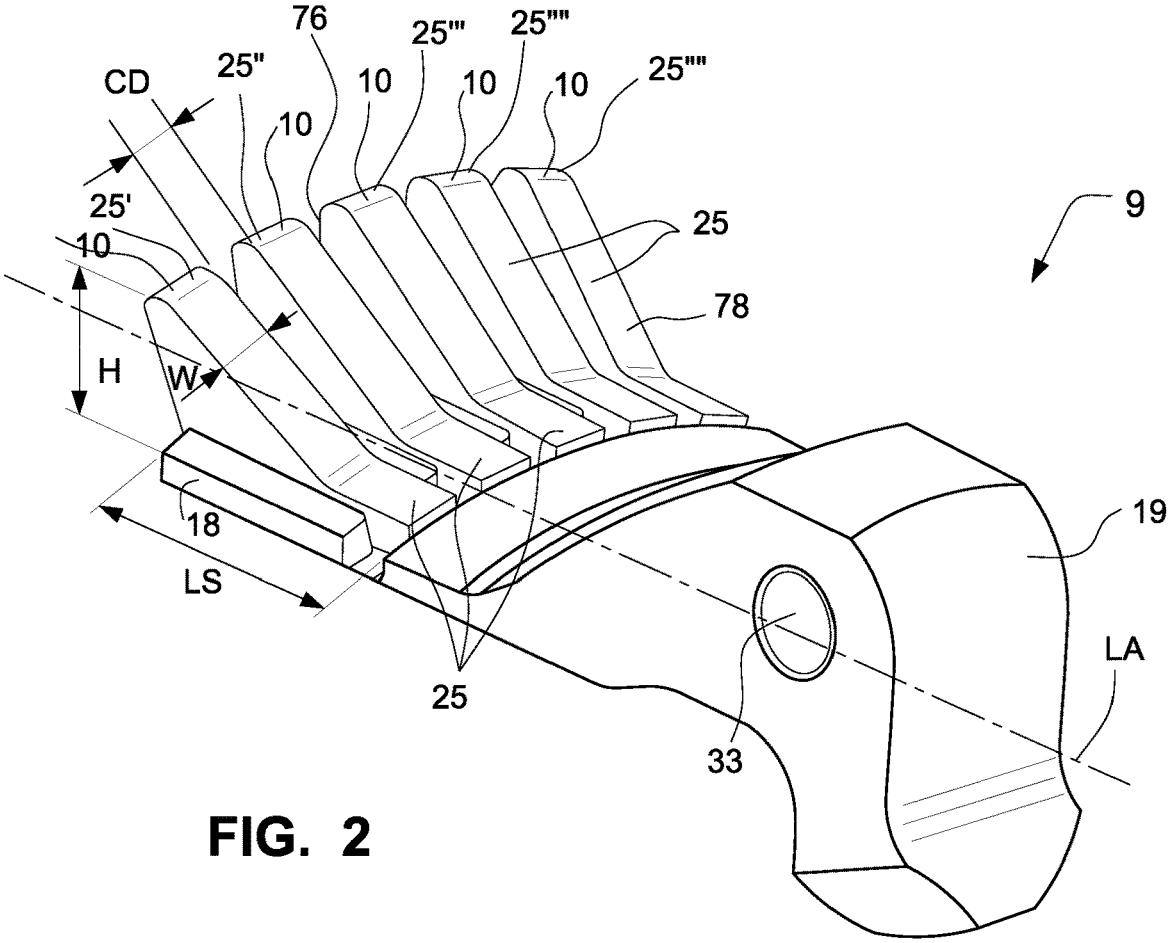
Figure 3:
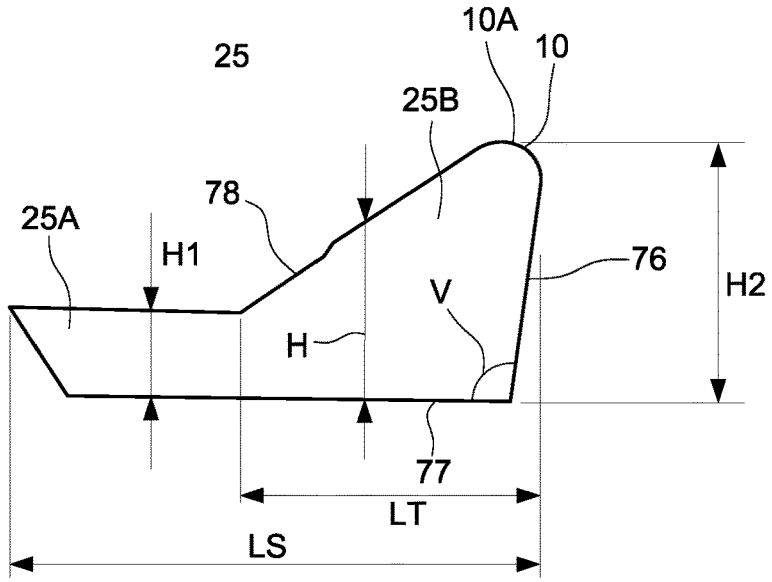
Figure 4:
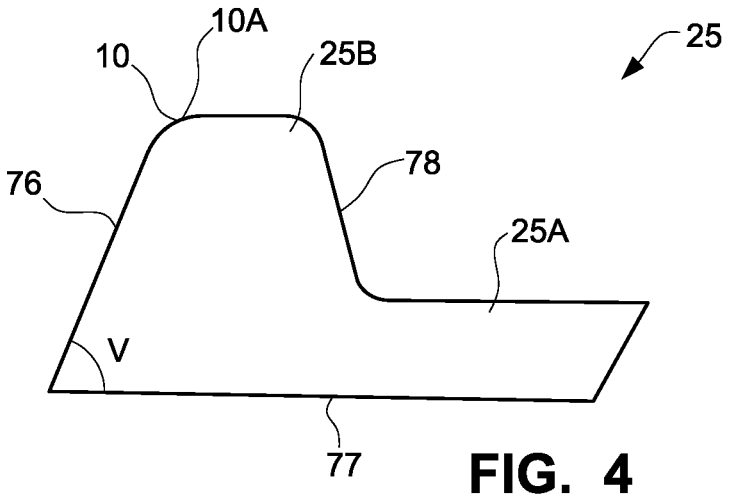
Figure 5:
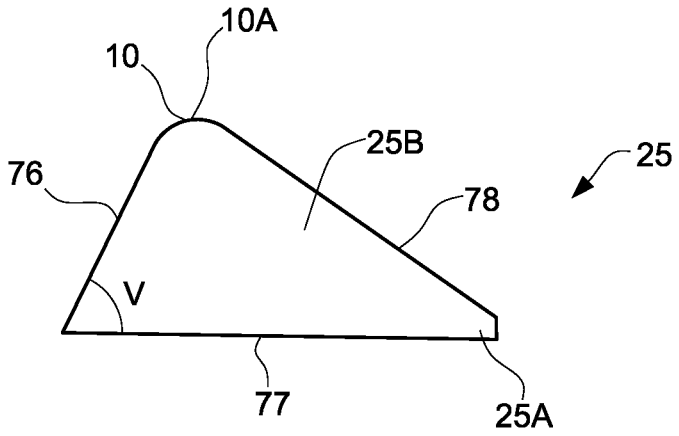
Figure 6:
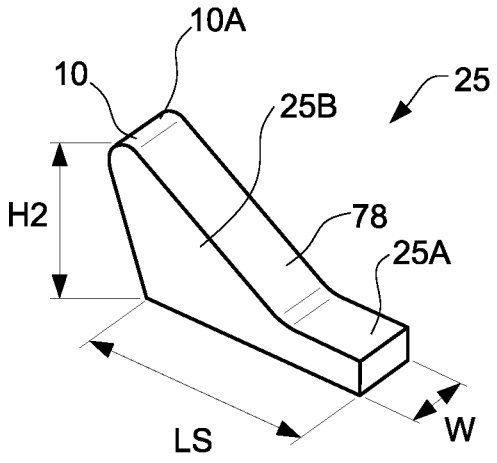
Figure 7:
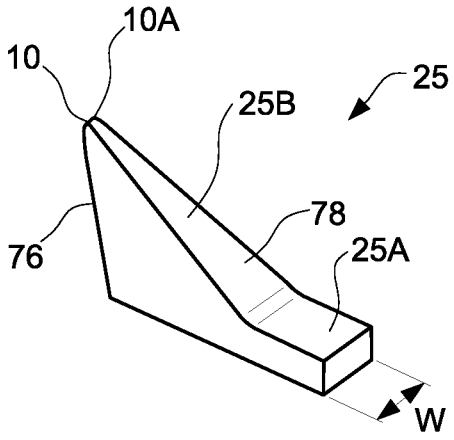
Figure 8:
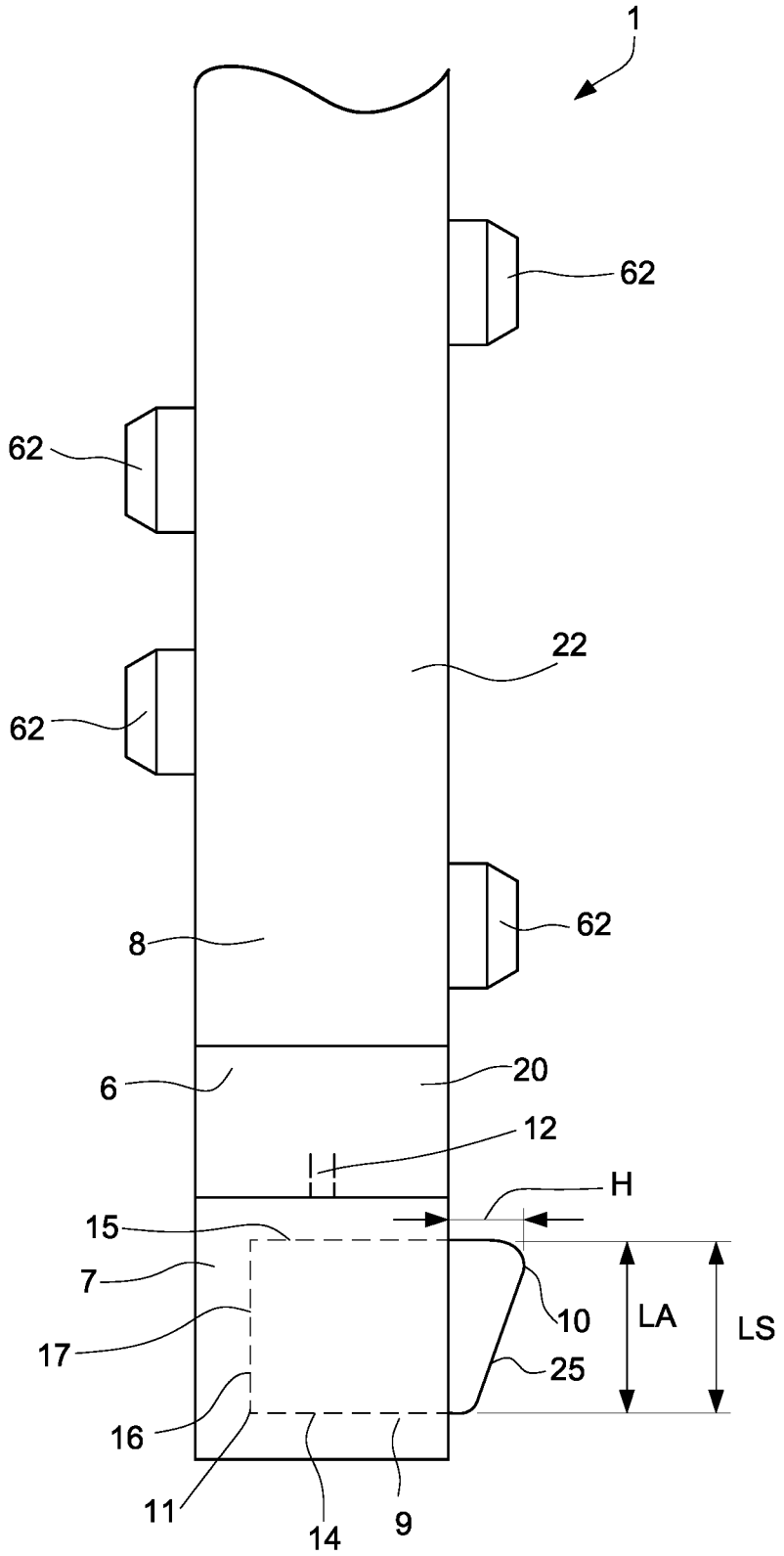
Figure 9:
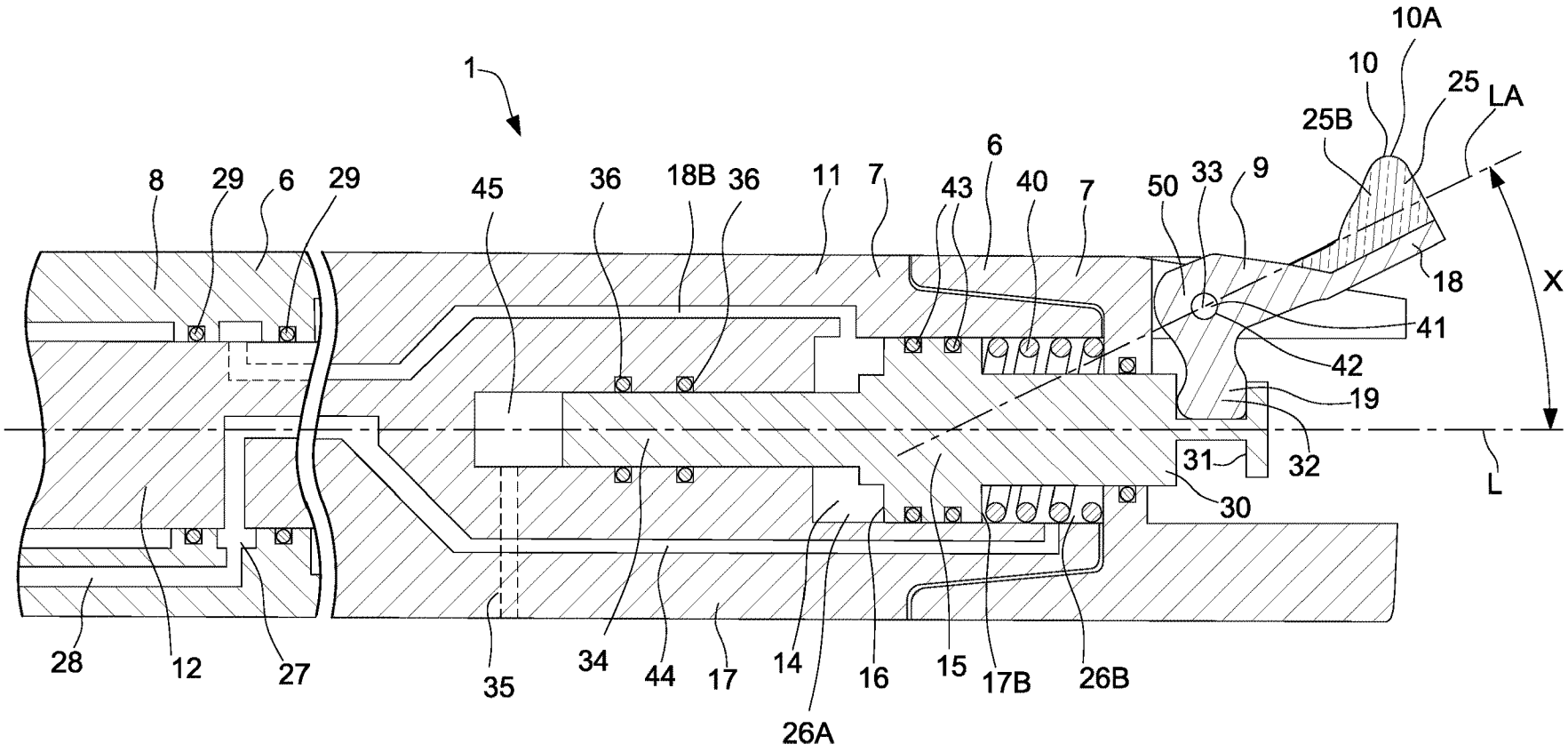
Figure 10:
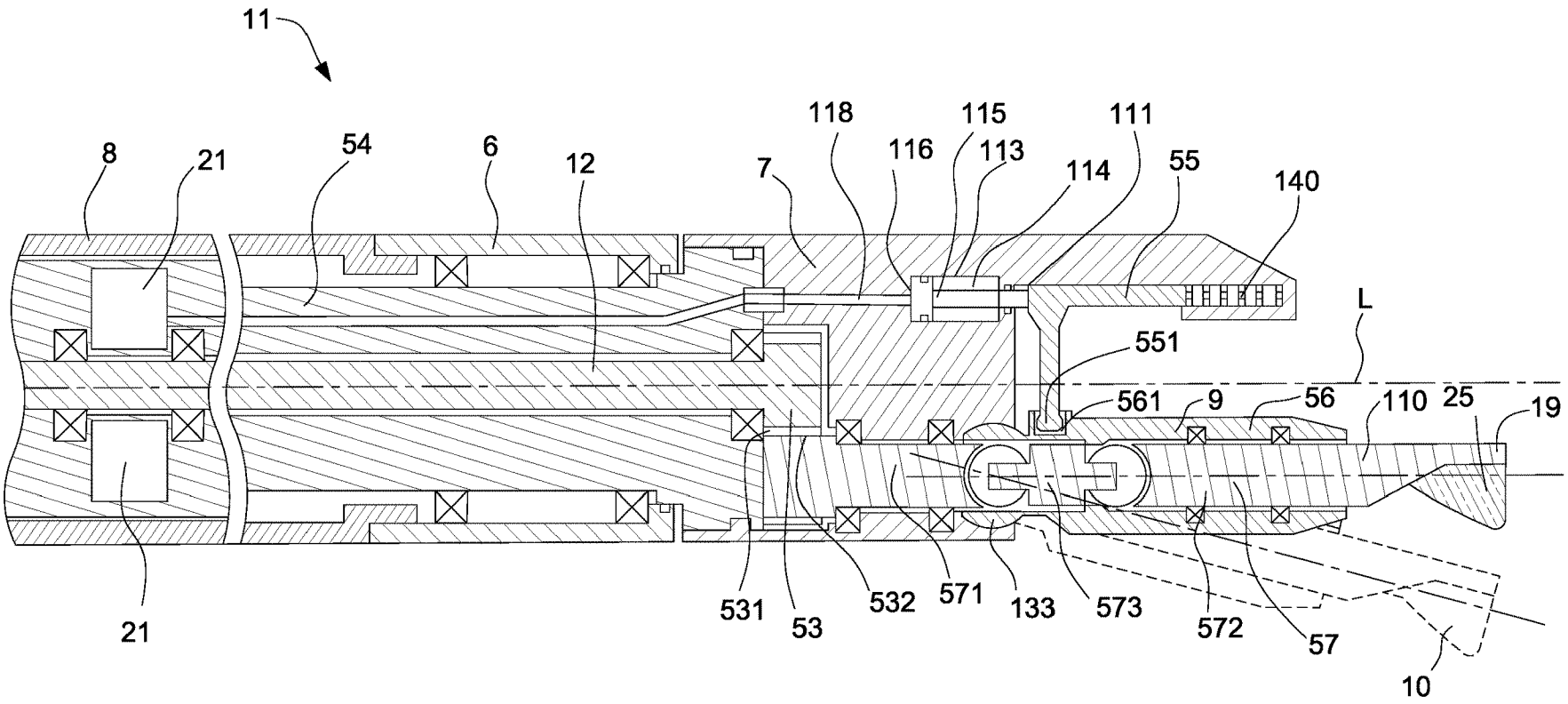
Figure 11:
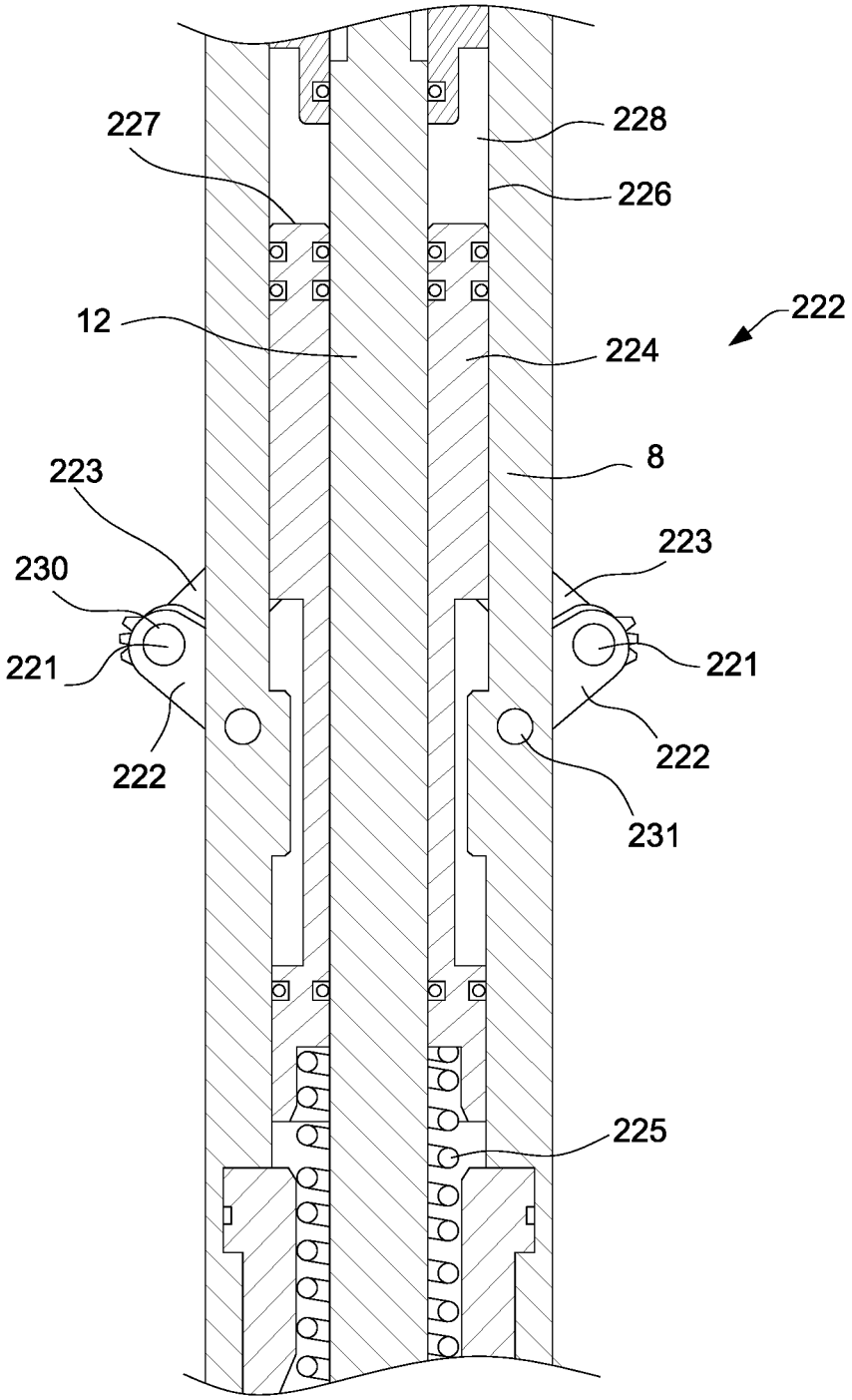
Figure 12A:
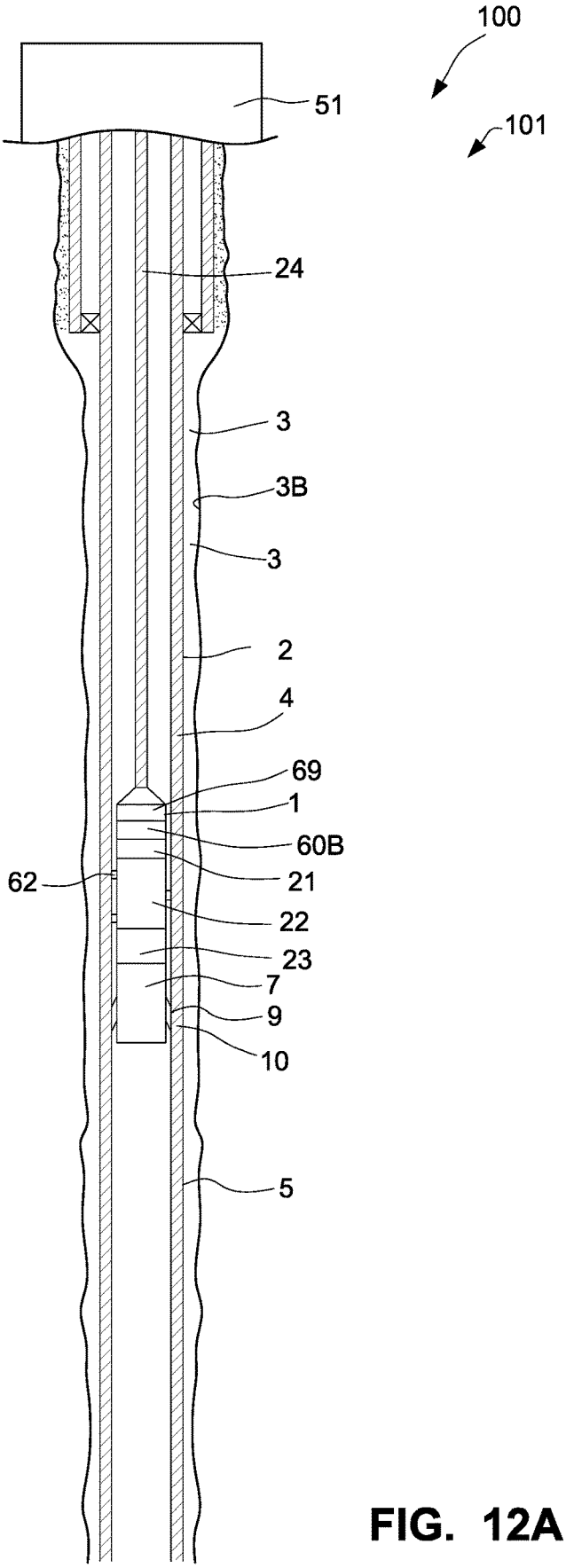
Figure 12B:
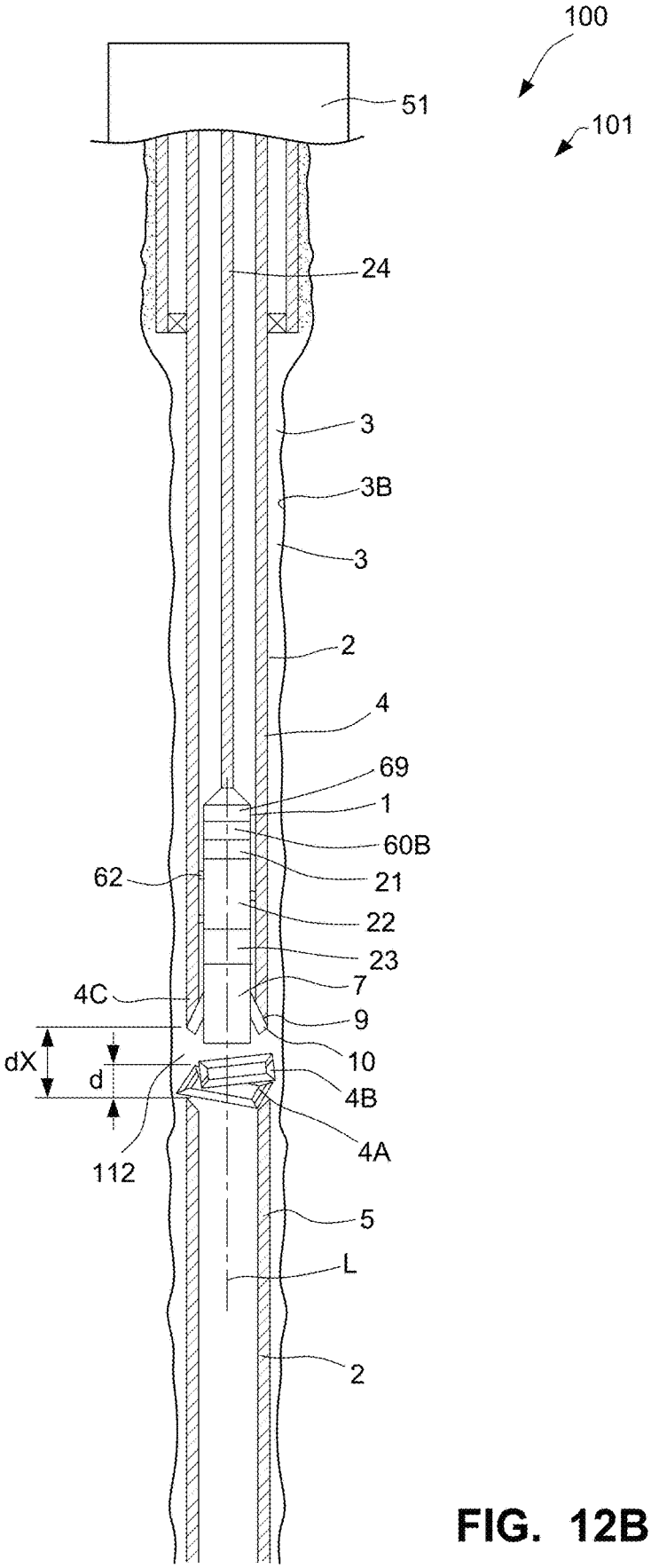
Figure 12C:
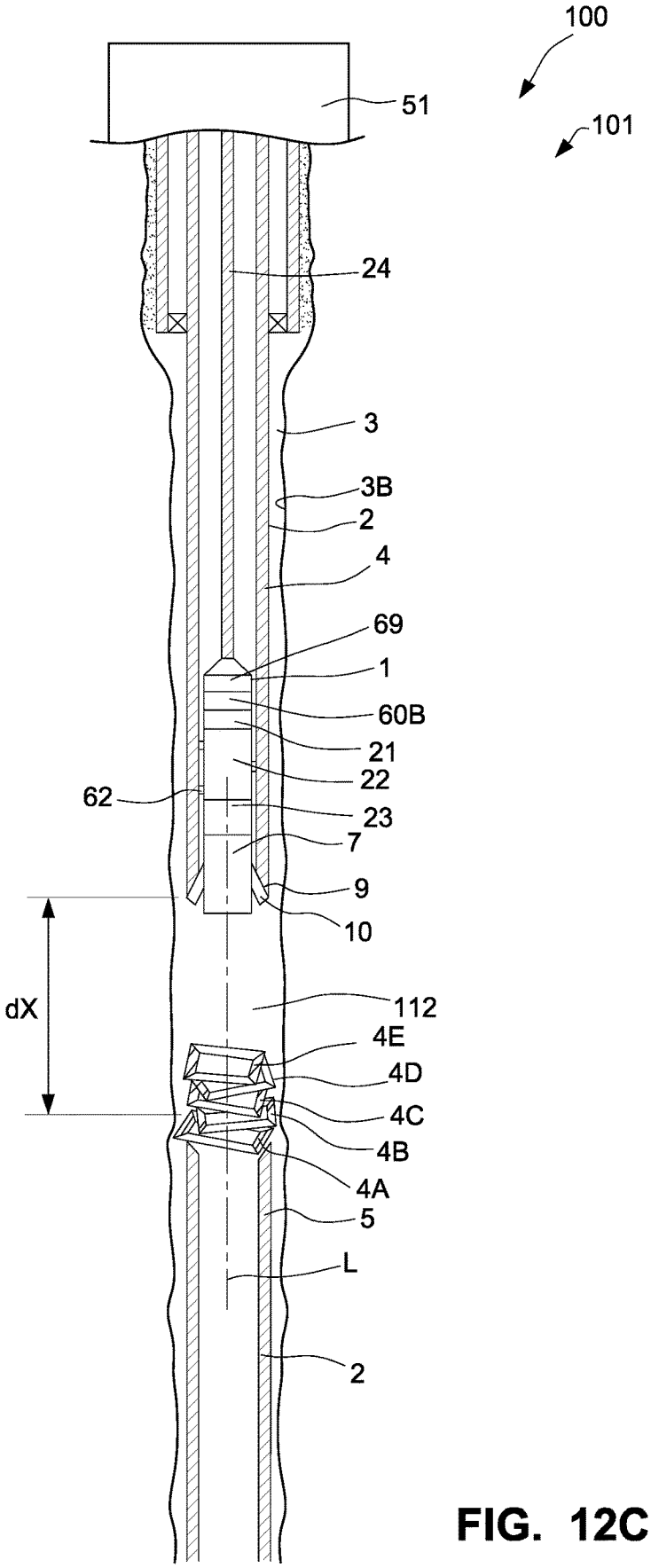
Figure 12D:
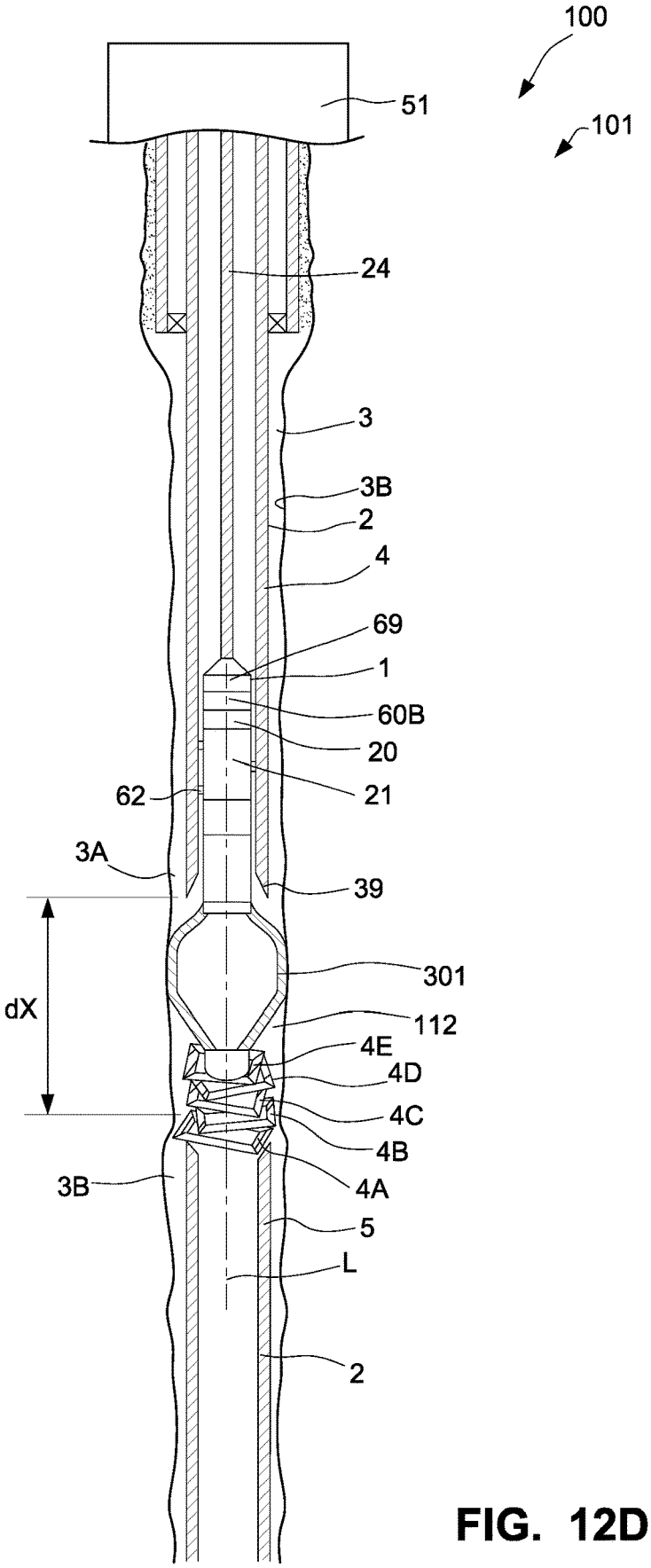
Figure 12E:
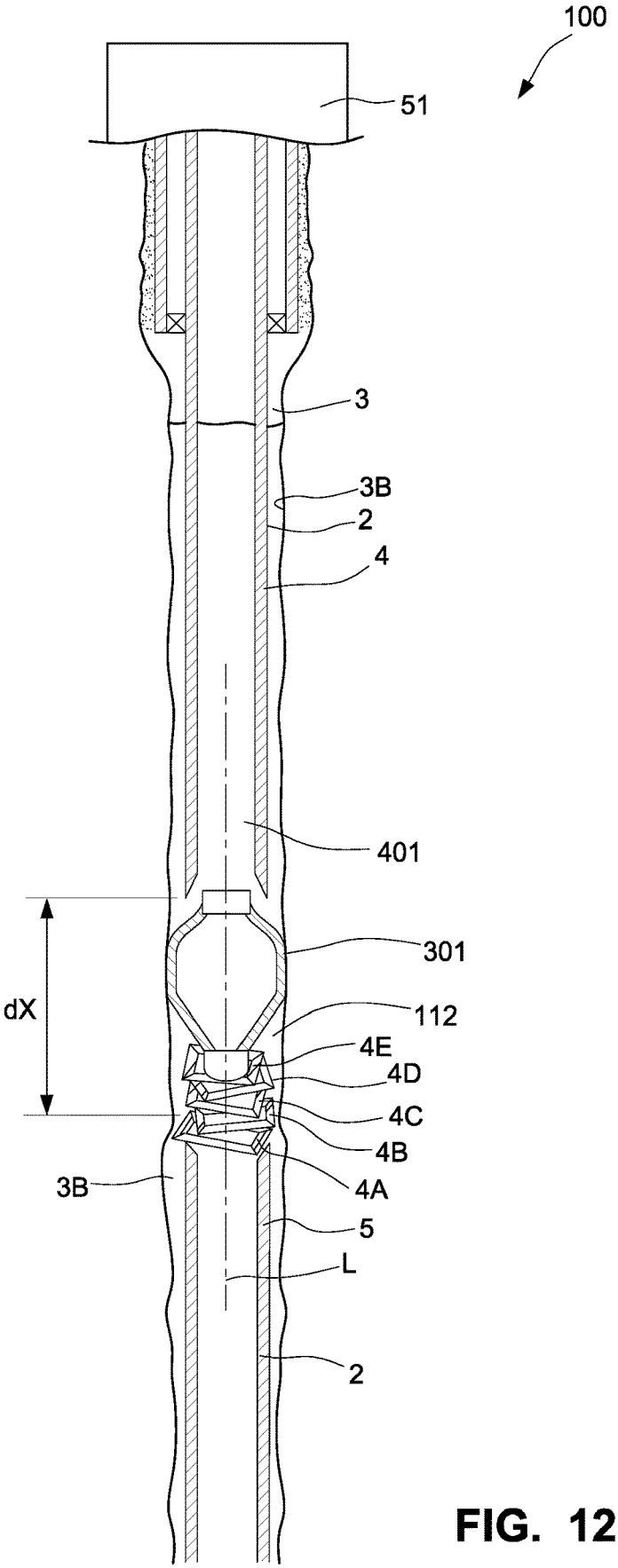
Figure 13:
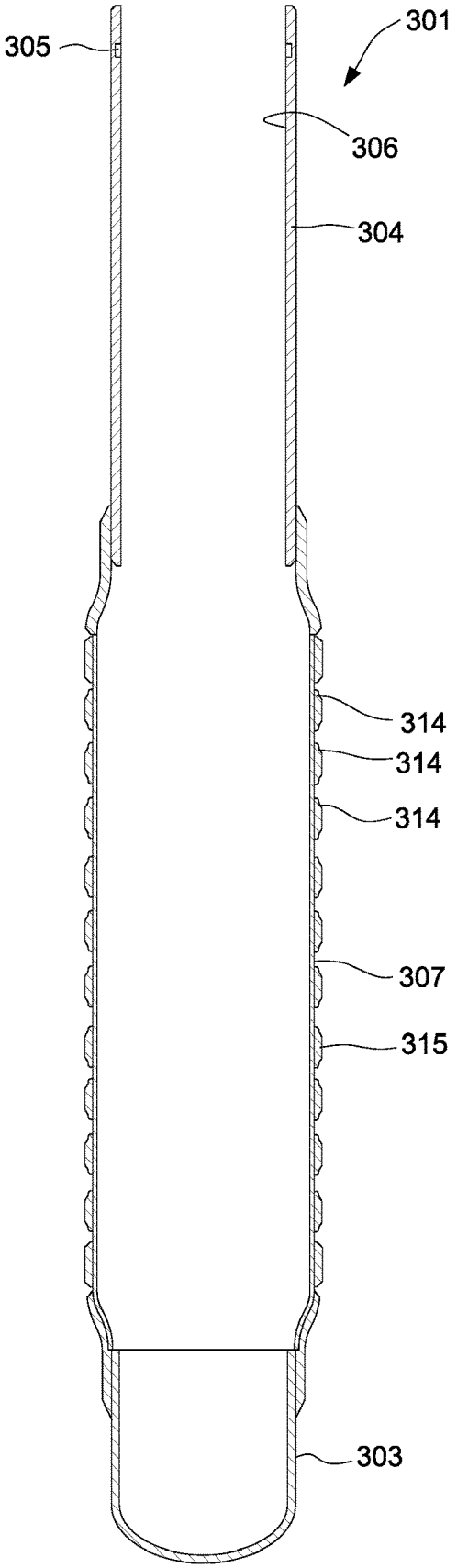
Figure 14:
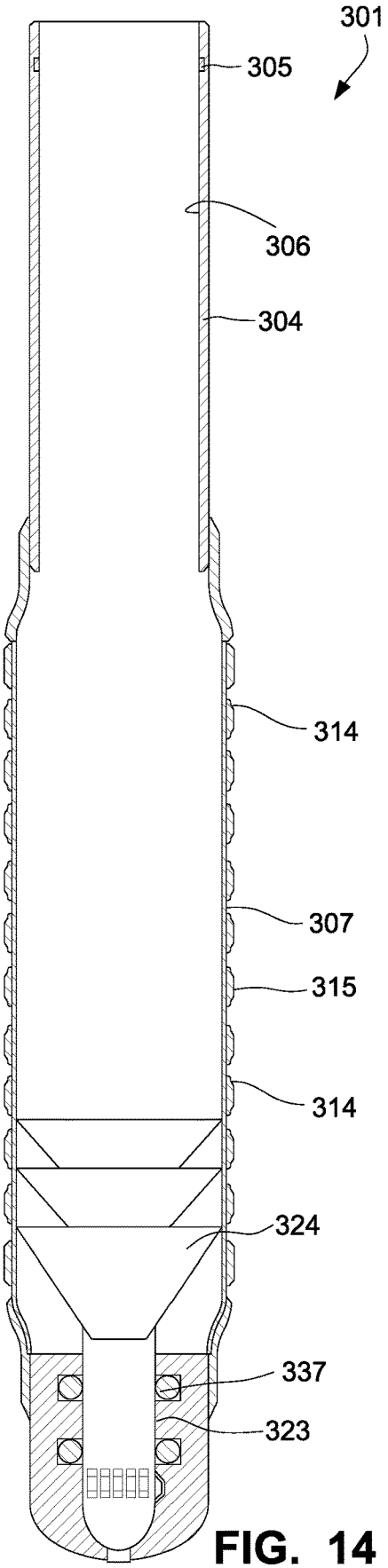
Figure 15:
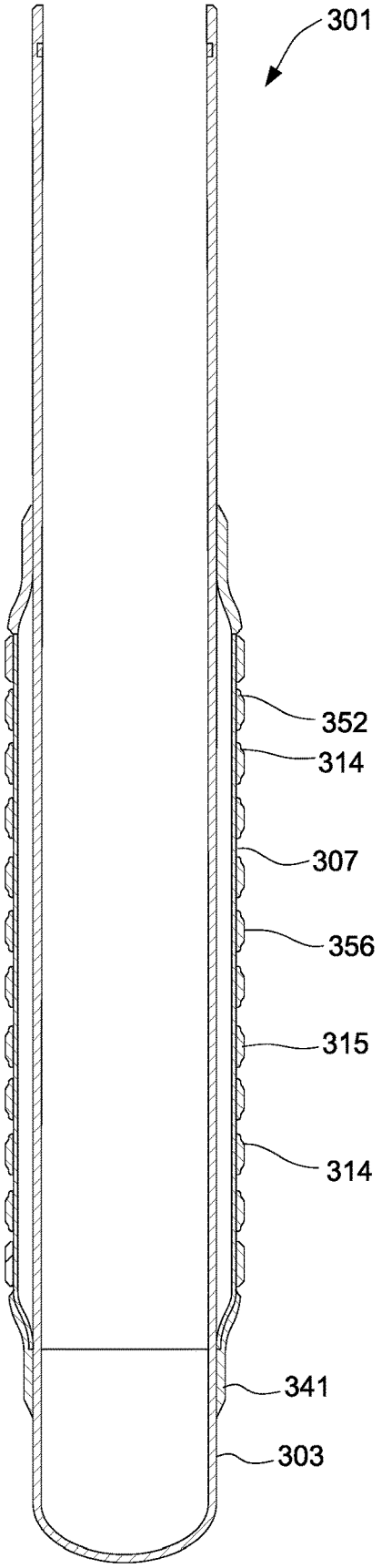
Figure 16A:
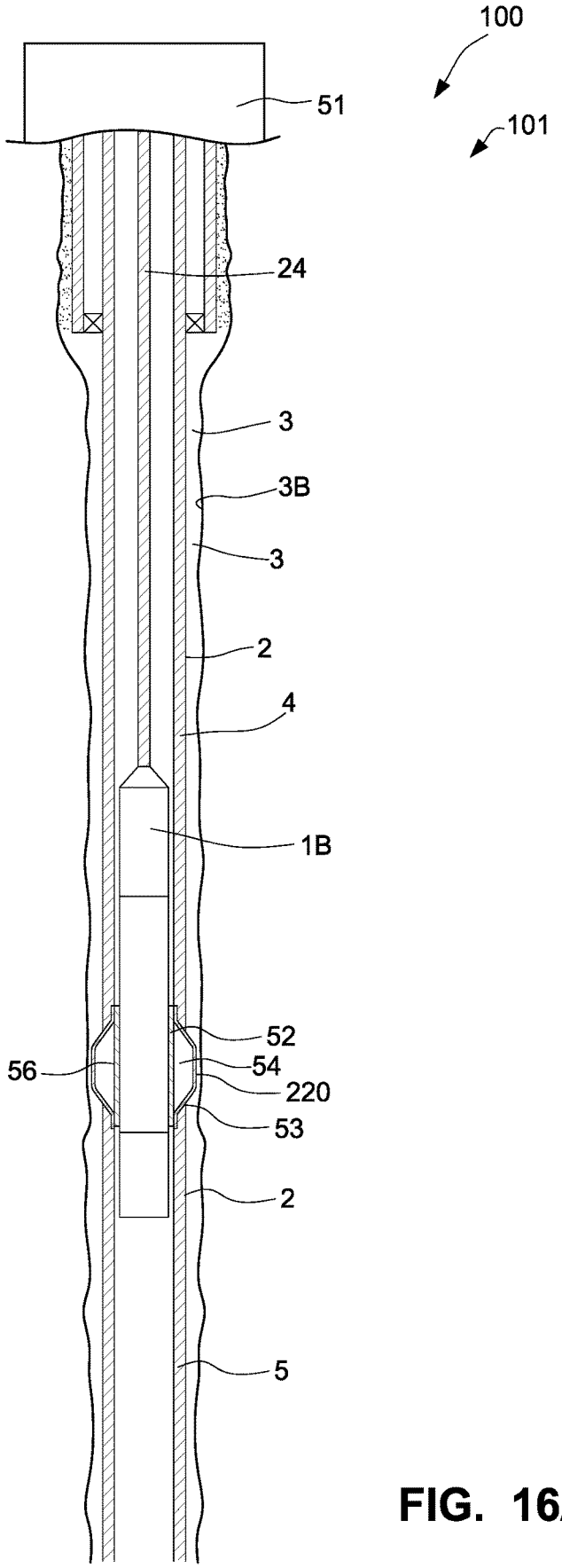
Figure 16B:
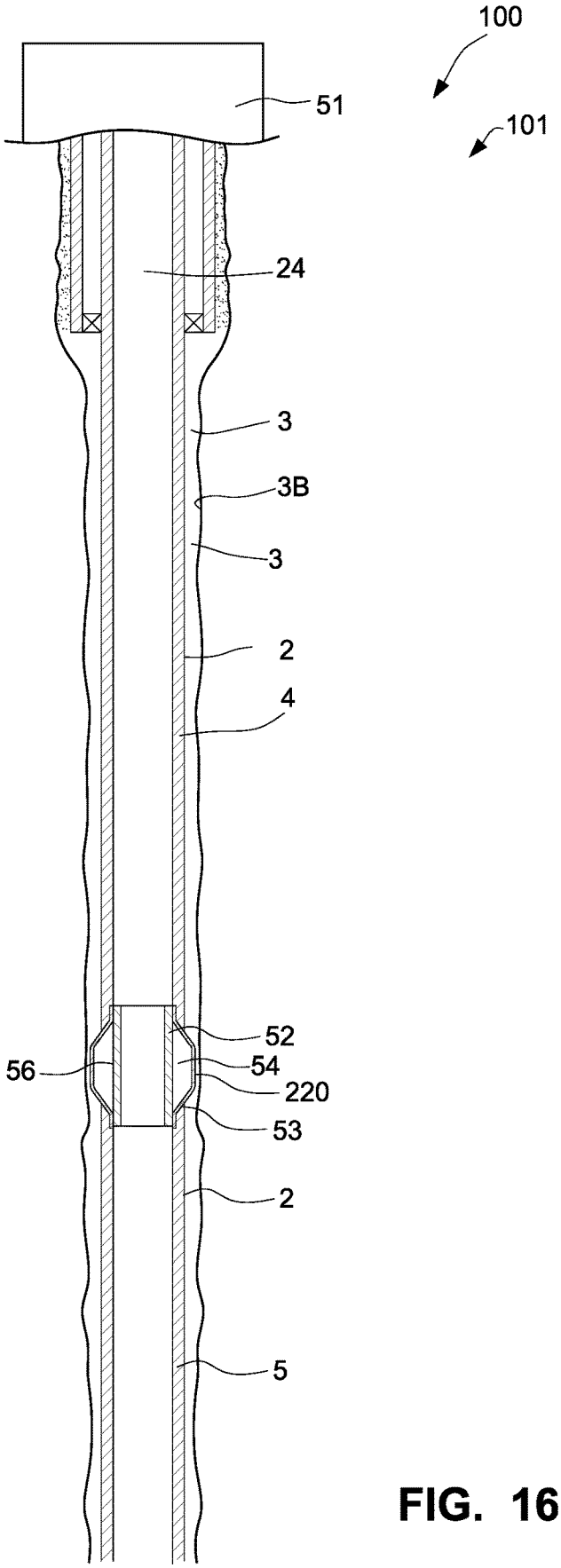

FIG. 1B shows a partial, cross-sectional view of a downhole tool in a well having a first well tubular metal structure surrounded by a second well tubular metal structure and a control line/hydraulic tube fastened to the outer face of the first well tubular metal structure and thus arranged between the first well tubular metal structure and the second well tubular metal structure, FIG. 2 shows a projection part having a plurality of segments, FIG. 3 shows a side view of a segment of the downhole tubing intervention tool, FIG. 4 shows a side view of another segment of the downhole tubing intervention tool, FIG. 5 shows a side view of yet another segment of the downhole tubing intervention tool, FIG. 6 shows a perspective of one of the segments of the projection part of FIG. 2, FIG. 7 shows a perspective of yet another segment of the downhole tubing intervention tool, FIG. 8 shows a part of yet another downhole tubing intervention tool, FIG. 9 shows a cross-sectional view of a part activation assembly, FIG. 10 shows a cross-sectional view of another part activation assembly, FIG. 11 shows a cross-sectional view of an anchoring section of the tool, FIG. 12A shows a partial, cross-sectional view of a downhole system having a downhole tool in a well having a first well tubular metal structure separating a first section from a second section, FIG. 12B shows the downhole system of FIG. 12A in which the downhole tool has separated several first parts from the first section of the first well tubular metal structure, providing an annular, uncased opening between the first section and the second section, FIG. 12C shows the downhole system of FIG. 12B in which the downhole tool has separated more first parts, providing a larger uncased opening, FIG. 12D shows the downhole system of FIG. 12C in which a second tool has expanded a barrier, such as a plug, opposite the uncased opening, FIG. 12E shows the downhole system of FIG. 12D in which cement has been poured onto the plug and in the uncased opening, FIG. 13 shows a cross-sectional view of a plug having an expandable metal sleeve, FIG. 14 shows a cross-sectional view of another plug having a seat receiving a cement wiper plug, FIG. 15 shows a cross-sectional view of yet another plug having a base part surrounded by an expandable metal sleeve, FIG. 16A shows a partial, cross-sectional view of another downhole system having a tool for setting an annular barrier in the uncased opening, and FIG. 16B shows the downhole system of FIG. 16A in which the downhole tool has been removed, leaving the annular barrier in the well.

All the figures are highly schematic and not necessarily to scale, and they show only those parts which are necessary in order to elucidate the invention, other parts being omitted or merely suggested.

FIG. 1A shows a downhole tubing intervention tool/downhole tool 1 for submerging into a casing/first well tubular metal structure 2 in a wellbore 3 and for selectively removing material from within the casing, e.g. for separating an upper part/first section 4 of the casing/first well tubular metal structure 2 from a lower part/second section 5 of the casing/first well tubular metal structure 2 by cutting or abrasive machining of the casing from within. The tool extends in a longitudinal direction L and comprises a tool housing 6 having a first housing part 7 and a second housing part 8. The second housing part 8 is arranged closer to a top 51 (shown in FIG. 12A) of the well when the tool is submerged into the well. The tool further comprises a rotation unit 20, such as an electric motor, arranged in the second housing part 8 and a rotatable shaft 12 rotated by the rotation unit 20 for rotating a bit 10 comprising at least a first segment 25 of abrasive material so that the at least first segment 25 of abrasive material on a projection part 9 is connected with the first housing part 7 and forms an abrasive edge of the bit 10. The first segment 25 and thus the bit 10 are movable between a retracted position and a projected position in relation to the first housing part 7 of the tool housing 6 so that the first segment 25 moves in a substantial radial direction R perpendicular to the longitudinal direction L of the tool and contacts the inner face of the casing 2. As can be seen, the tool comprises a plurality of segments.

The first segment 25 is movable between a retracted position and a projected position by means of hydraulics/hydraulic power. By having a hydraulically operated part activation assembly 11, the first segment 25 can be projected continuously outwards as the segment is worn so that the size-reduced segment is still able to contact the casing 2 with enough weight on bit (WOB), continuing the removal operation.

The downhole tubing intervention tool/downhole tool 1 further comprises a gear section 23 arranged between the rotation unit 20 and the first housing part 7 for changing the rotation of the rotatable shaft 12 so that the first housing part 7 rotates at a lower or higher speed. The downhole tubing intervention tool/downhole tool 1 is a wireline tool, i.e. the tool receives power through a wireline 24. An electrical control unit 69 is arranged between the connection to the wireline 24 and a motor 20 of the tool. The tool also comprises a compensator 60B ensuring a slight overpressure inside the tool. The electric motor both powers a pump 21 and rotates the first housing part 7 and the first segment 25. Even though not shown, the downhole tubing intervention tool/downhole tool 1 may have another motor besides the rotation unit 20 so that one motor drives the pump 21 and another rotates the first housing part 7 and the first segment 25. The downhole tubing intervention tool/downhole tool 1 may further comprise a driving unit 59, such as a downhole tractor comprising wheels 60 on wheel arms 61, for propelling the tool forward in the well in other parts of the well than in the vertical part. The downhole tubing intervention tool/downhole tool 1 is submerged into the well or casing 2 only by the wireline 24, e.g. with another kind of power supply line, such as an optical fibre, and not by tubing, such as coiled tubing, a drill pipe or similar piping.

As shown in FIG. 1A and 1B, the first segment 25 abuts the inner face 63 of the casing 2 in order to selectively remove material from within the casing 2 and separate a first section 4 being an upper part 4 of the casing/well tubular metal structure from a second section 5 being a lower part 5 of the first well tubular metal structure by machining into and along a circumference of the first well tubular metal structure. After the separation shown in FIGS. 1A and 1B, the downhole tool is moved a predetermined distance d along the longitudinal extension in the first section of the first well tubular metal structure to a second position above the predetermined position, and then the tool (e.g., as shown in FIGS. 12B-12D) separates a first part 4A of the first section of the first well tubular metal structure from a second part 4B of the first section of the first well tubular metal structure by machining into and along a circumference of the first well tubular metal structure, providing an uncased opening 112 between the second part of the first section and the second section. The first part of the first section of the first well tubular metal structure is left in the well.

By the leaving the cut out first part of the first section of the first well tubular metal structure in the well, the uncased opening can be made anywhere in the well without spending time on taking the upper of the well tubular metal structure out the well first or this first part of out the well. Thus, this method provides a much faster way of plugging and abandoning a well, and this method also provides a much cheaper way of plugging and abandoning the well. Especially the cost is very important as when making the well, i.e. drilling the borehole, completing the well etc., the operator has to deposit money for the plugging and abandoning the well in the event that the operator does not have the funds to do so when needed many years later. Therefore, if the operator can present a plugging and abandoning method which costs less than conventional methods, and the operator can reduce the deposit amount accordingly. Conventional methods pull out the part of the completion/well tubular metal structure being above the position where the barrier is to be set and thus a lot of money is spent in doing so.

The separation is performed by machining into the casing using abrasive cutting, i.e. grinding, by forcing the first segment 25 against the inner face while rotating the segment and thereby providing a circumferential cut of removed material by means of a non-chip-producing operation. Thereby, the removed material of the casing 2 is only transformed into small particles and not a long chip as is the case with the known cutting tools. It is very difficult to bring such long chips left in the well to the surface, but these chips may be large enough for interacting with intervention tools or completion products later on.

When using a segment, such as an insert, of abrasive material instead of known metal cutting inserts, unintended vibrations do not hinder the machining operation from finishing. When experiencing unintended vibrations, the known metal cutting inserts are damaged as the cutting edge hits against the casing and small fragments are knocked off, the metal cutting inserts no longer having a cutting edge able to cut, and the tool needs to be retracted from the well. When having a segment of abrasive material, small knocked-off fragments will just expose new abrasive grains in the abrasive material, and the grinding process can continue. The segment thus mills or grinds into the element to be removed from the well, e.g. part of the casing wall, a nipple, a sliding sleeve, a no-go, a valve, etc.

In other situations, the downhole tubing intervention tool/downhole tool is submerged into a casing which is surrounded by a sleeve or a second casing as shown in FIGS. 1A and 1B, and the downhole tubing intervention tool/downhole tool needs to selectively remove material from within the casing to separate both the casing/well tubular metal structure and the sleeve or the second casing/well tubular metal structure. This is not possible if the separation of the first casing destroys the segment as then the segment cannot separate the second casing or the sleeve. However, when the segment is of an abrasive material which, when worn, merely reduces in size and new particles in the segment are exposed, the separation operation can easily proceed with success as the segment is merely projected a bit further for compensating for the reduced size of the segment.

In FIG. 1B, a control line or hydraulic tube 38 is arranged between the first well tubular metal structure 2 and a second well tubular metal structure 2B, and the control line 38 is clamped onto the outer face of the first well tubular metal structure 2. An optimal way of also being able to cut the control line/hydraulic tube 38 into a first part 38A and a second part 38B is to cut or grind close to one of the clamps 46 and not directly in the clamp 46 as then the bit 10 is more worn than if only cutting/grinding into the first well tubular metal structure 2 and the line/tube 38.

The segment/bit may be an abrasive segment or a grinding segment, such as a grinding stone. The segment of abrasive material is a non-chip-producing material. Thus, the segment is of a non-chip-producing material.

The segment 25 of abrasive material comprises grains of diamond or Cubic Boron Nitride, aluminium oxide (corundum), silicon carbide, tungsten carbide, ceramic or similar material. The segment 25 of abrasive material comprises a binder, such as iron, cobalt, nickel, bronze, brass, tungsten carbide, ceramic, resin, epoxy or polyester.

As shown in FIGS. 3 and 6, the segment 25 tapers from a base part 25A into a terminal end 10A, forming a radial tip 25B. The first segment 25 has a segment length LS along the longitudinal axis in the retracted position, and the segment 25 has a segment height H, H1, H2 perpendicular to the longitudinal axis. The radial tip 25B has a tip length LT along the longitudinal axis being less than 75% of the segment length. The segment height at the base part 25A is a first segment height H1, and the segment height at the radial tip 25B is a second segment height H2. The second segment height H2 is approximately three times the first segment height H1 in FIG. 3. In another embodiment, the second segment height H2 is higher than the first segment height H1, and preferably at least two times higher than the first segment height H1. The radial tip 25B of FIG. 3 has a front face 76 facing away from the tool and a back face 78 facing towards the main part of the tool. The front face 76 is inclining inwards or backwards from the terminal end 10A towards the back face 78. The segment 25 has an angle V between the base face 77 and the front face 76 of more than 90° so that the radial tip 25B is more acute than if the front face 76 did not incline backwards. In FIG. 4, the front face 76 of the radial tip 25B inclines away from the base part 25A, forming a less acute radial tip 25B as the angle v is more than 90°. By having an acute radial tip 25B as in FIG. 3, the segment 25 and thus the tool are less likely to get stuck while cutting, grinding or milling into the casing 2, separating the upper part 4 from the lower part 5 (shown in FIG. 1A or 1B). If the radial tip 25B has a large tip engaging the casing 2 at the same time, it requires a higher amount of power than what can sometimes be provided to a tool several kilometres down the well. Furthermore, when separating the upper part 4 of the casing 2 from the lower part 5, the tool may be carrying the upper part 4 when the segment 25 has cut through the casing wall, and thus the segment 25 can be stuck.

As shown in all the FIGS. 1A, 1B-9 and especially in FIG. 3, the first segment 25 has a base part 25A, as shown in FIG. 3, and a projection part 9 projecting from the base part 25A, forming the radial tip 25B. Thus, the first segment 25 tapers from a base part 25A into a terminal end 10A, forming a radial tip 25B of the projection part 9. In operation, the radial tip 25B contacts the inner face of the casing 2 for selectively removing material from the casing, e.g. in order to separate/saw through the casing 2, and when the segment of an abrasive material is worn during the removal operation, the projection part 9 of the segment is merely reduced in size and new particles/diamonds in the segment are exposed, and the separation/removal operation can easily proceed with success as the remaining part of the projection part 9 of the segment is merely projected a bit further for compensating for the reduced size of the segment. When separating a sleeve or a second casing surrounding the first casing into two, the base part also becomes abrasive, removing further material from the first casing so that the projection part having separated the first casing can project further to also separate the second casing. Thus, the base part 25A, the radial tip 25B and the projection part 9 are of abrasive material.

As can be seen in FIG. 6, the terminal end 10A of the radial tip 25B forms the abrasive edge 10. This is the same in FIG. 4 where the terminal end 10A appears as a square face rather than a line or edge, but once the projection part 9 projects from the tool housing 6, the segment is tilted, and then the terminal end 10A forms the abrasive edge 10. The abrasive edge 10 cuts into an element in the well from within the casing 2, and as the edge is worn the abrasive edge 10 becomes larger, and the terminal end 10A also machines into the adjacent parts of the cut in order to remove further material from the casing 2.

The first segment 25 may also be the radial tip 25B tapering from a base part 25A arranged between the base face 77 and the radial tip 25B as shown in FIG. 5. Thus, the base part 25A has approximately the same length as the base part and the segment length. The first segment 25 has a segment width W as shown in FIGS. 2, 6 and 7, and in FIG. 7, the radial tip 25B also tapers in the circumferential direction of the tool into a smaller terminal end 10A than that of FIG. 6. In that way, the face in engagement with the casing wall or another element in the well to be machined is smaller and thus requires less power in order to rotate the segment(s) and the first housing part 7 than if the terminal end 10A was larger. When being several kilometres down the well, no more than 600 Volt or 3-5 W may be available to power the tool downhole, and thus such tapering may be the difference determining whether the tool is able to operate or not.

In FIGS. 1A and 1B, the downhole tubing intervention tool/downhole tool 1 further comprises a projection part 9 movable between a retracted position and a projected position in relation to the first housing part 7 of the tool housing 6. As shown in FIG. 2, the projection part 9 has a first end 18 and a second end 19. The second end 19 is movably connected with the first housing part 7, and the first end 18 is connected with the first segment 25, 25'. The tool further comprises a part activation assembly 11, as shown in FIGS. 8-10, for moving the projection part 9 between the retracted position and the projected position, e.g. by means of hydraulics. The projection part 9 is shown in its projected position in FIGS. 1, 8 and 9, but in its retracted position in FIG. 10 (dotted lines indicate the projected position). The projection part 9 moves the segment(s) between the retracted and projected positions, and the projected position is never more than when the back face 78 of the first segment 25 is not perpendicular to the longitudinal axis of the casing 2 but always inclines downwards so that the downhole tubing intervention tool/downhole tool 1 can always be retracted from the well by pulling the tool upwards. If the back face 78 was vertical, the downhole tubing intervention tool/downhole tool 1 would be at risk of getting stuck. The removal process removes material from the casing 2, and a triangular groove is made.

The projection part 9 shown in FIG. 2 has a second segment 25" arranged at a distance CD from the first segment 25, 25' along a circumference of the tool. The projection part 9 of FIG. 2 has five segments where the third segment 25'" is also arranged at the distance CD from the second segment and the fourth segment 25"", which again is arranged at the distance CD from the fifth segment 25""", along the circumference of the tool. Thus, the projection part 9 has several segments connected to the first end 18. The projection part 9 has a part extension LA, the segment length LS of the first segment extends along the part extension, and the segment height H extends perpendicularly to the part extension in a radial direction R (shown in FIG. 1) of the tool. By having a distance between the segments, less contact with the inner face of the casing 2 is obtained than compared with one larger segment covering the same area as five segments. Thus, less power is required to rotate the projection part 9, and the particles created from the material-removing process can easily move away from the contact area through the space between the segments.

In FIGS. 1A and 1B, the projection part 9 is pivoting between the retracted position and the projected position. The projection part 9 thus has a pivot point 33 as shown in FIGS. 2 and 9. In FIG. 9, the part activation assembly 11 comprises a piston housing 17 arranged in the first housing part 7 and comprising a piston chamber 14, and a piston member 15 arranged inside the piston chamber 14 for moving the part between the retracted position and the projected position. The piston member 15 is movable in the longitudinal direction of the downhole tubing intervention tool/downhole tool 1 and has a first piston face 16, and the piston member 15 is capable of applying a projecting force on the projection part 9 by hydraulic pressure applied on the first piston face 16 and thereby moving the piston in a first direction, applying an axial force converted into a dynamic cutting force through a rolling CAM contact in pos. 31, 32 and pivot point 33. Hydraulic fluid from the pump is pumped into a first chamber section of the piston chamber 14 through a first fluid channel 18B, applying hydraulic pressure on the first piston face 16, and the piston moves in a first direction, applying an axial force on the projection part 9. The axial force is converted into a dynamic cutting force through the pivot point 33 and the terminal end 10A of the radial tip 25B.

FIG. 8 shows a part of another embodiment of the downhole tubing intervention tool/downhole tool 1 where the part activation assembly 11 also comprises the piston housing 17 arranged in the first housing part 7 and the piston member 15 arranged inside the piston chamber 14 for moving the projection part 9 between the retracted position and the projected position. However, the piston member 15 is movable in a direction perpendicular to the longitudinal direction of the downhole tubing intervention tool/downhole tool 1. The piston member 15 is also capable of applying a projecting force on the projection part 9 by hydraulic pressure applied on the first piston face 16, moving the piston member 15 in a first direction radially outwards from the tool housing 6. The downhole tubing intervention tool/downhole tool 1 comprises an anchoring section 22 having four anchors 62 extendable from the tool housing 6 for anchoring the tool in the casing 2.

The downhole tubing intervention tool/downhole tool 1 may further comprise a stroking unit (not shown), such as a stroking tool, providing a movement of the first housing part 7 and the first segment 25 in the projected position along a longitudinal extension of the casing 2 or the first well tubular metal structure 2. The stroking unit is arranged between the anchoring section 22 and the first housing part 7 so as to be able to project the first housing part 7 from the anchoring section/anchor section 22. Thus, when the downhole tubing intervention tool/downhole tool 1 is submerged into the casing/first well tubular metal structure 2, and the anchoring section 22 of the downhole tubing intervention tool/downhole tool 1 is hydraulically activated to anchor the first housing part 7 of the downhole tubing intervention tool/downhole tool 1 in relation to the first well tubular metal structure 2, the first segment 25 removes material from the first well tubular metal structure 2 along a circumference and the longitudinal extension of the first well tubular metal structure 2. In that way, a section of the first well tubular metal structure 2 is removed from the first well tubular metal structure 2, thereby grinding a part of the first well tubular metal structure 2 into insignificantly small pieces/particles, creating or re-creating annular isolation. The section removed from the first well tubular metal structure 2 extends all the way around the circumference of the first well tubular metal structure 2 and may have a length along the longitudinal extension of the first well tubular metal structure 2 of more than 0.5 metre, preferably more than 1 metre, and even more preferably more than 5 metres. Thus, removing a section of the casing/first well tubular metal structure 2 provides access to the annulus surrounding the first well tubular metal structure 2 for creating or re-creating annular isolation, i.e. zone isolation in the annulus, or cement can be poured into the annulus, e.g. for Plug and Abandonment (P&A) operations, or an annular barrier may be arranged and expanded opposite the section to provide zone isolation in the annulus.

As shown in FIGS. 1A and 1B, the downhole tubing intervention tool/downhole tool 1 is a downhole tubing separation tool separating the upper part/first section 4 of the casing/first well tubular metal structure 2 from the lower part/second section 5 of the casing/first well tubular metal structure by abrasively machining the casing from the inside of the casing, e.g. for producing a slightly bevelled cut.

When the projection part 9 is projected to press against an inner face of the casing 2 and is simultaneously rotated by the motor through the rotatable shaft 12, the abrasive edge 10 is capable of milling or grinding through the casing or drill pipe without producing chips, but merely particles. Thereby, it is obtained that the upper part 4 of the casing can be separated from the lower part 5 of the casing by cutting the casing from within without the use of explosives. In FIG. 9, fluid from the pump is supplied through a circumferential groove 27 fluidly connected with a second fluid channel 28 in the second housing part 8. Thus, the fluid from the second fluid channel 28 is distributed in the circumferential groove 27 so that the first fluid channel 18B is always supplied with pressurised fluid from the pump while rotating. The circumferential groove 27 is sealed off by means of circumferential seals 29, such as O-rings alone or slipper seals combined with O-rings acting as an energizer to establish a sealing surface on both sides of the circumferential groove 27. The piston member 15 moves in the longitudinal direction of the downhole tubing intervention tool/downhole tool 1 inside the piston chamber 14 and divides the piston chamber 14 into a first chamber section 26A and a second chamber section 26B. When the piston member 15 moves in the first direction, a spring member 40 abutting a second piston face 17B opposite the first piston face 16 is compressed. As the spring member 40 is compressed, so is the second chamber section 26B, and the fluid therein flows out through a fourth channel 44 fluidly connected with the second fluid channel 28. The spring member 40, which is a helical spring surrounding part of the piston member 15 arranged in the second chamber section 26B, is thus compressed between the second piston face 17B and the piston chamber 14. The piston member 15 has a first end 30 extending out of the piston housing 17 and engaging the projection part 9 by having a circumferential groove 31 into which a second end 32 of the projection part 9 extends. The second end of the projection part 9 is rounded to be able to rotate in the circumferential groove 31. The projection part 9 is pivotably connected with the first housing part 7 around a pivot point 33. In the other and second end 34 of the piston member 15, the piston member is connected with the rotatable shaft 12. When the piston member 15 is moved in the first direction, a space 45 is created at the second end 34 of the piston member. This space 45 is in fluid communication with the well fluid through a third channel 35, which is illustrated by a dotted line. In this way, the piston member 15 does not have to overcome the pressure surrounding the tool in the well. The second end 34 of the piston member 15 is provided with two circumferential seals 36 in order to seal off the piston chamber 14 from the dirty well fluid or well contaminants. When the machining operation is over, the hydraulic pressure from the pump is no longer fed to the first channel, and the spring member 40 forces the piston member 15 in a second direction opposite the first direction along the longitudinal direction L of the tool, as indicated in FIG. 9. When seen in cross-section, the projection part 9 has an abrasive edge 10 forming an outermost point of the projection part 9 when the projection part 9 is in its projected position so that the abrasive edge 10 is the first part of the projection part 9 to abut the inner face of the casing 2 or drill pipe. In this way, the casing 2 or drill pipe can be machined or separated from within the casing 2 or drill pipe. When seen in the cross-sectional view of FIG. 9, the projection part 9 thus moves from a retracted position, in which the projection part 9 is substantially parallel to the longitudinal direction of the tool, to the projected position, as shown, in which the projection part 9 has an angle X to the longitudinal direction L of the tool. Thus, the abrasive edge 10 of the first segment 25 projects radially from the round tool housing 6. As shown in the cross-sectional view of FIG. 9, the projection part 9 is L-shaped, creating a heel part 50, and is pivotably connected around the pivot point 33 in the heel part 50. Thus, the projection part 9 has the first end 18 with the first segment 25 and the second end 19 cooperating with the piston member 15. Between the first and second ends 18, 19, in a pivoting point, a pin 41 penetrates a bore 42 in the projection part 9. In FIG. 9, the tool is shown with only one projection part 9 for illustrative purposes. However, in another embodiment the tool has three projection parts 9 arranged 120° apart from each other. The piston member 15 is substantially coaxially arranged in the tool housing 6 and has two circumferential seals 43, such as O-rings.

FIG. 10 shows another embodiment of a downhole tubing intervention tool/downhole tool 1. Like the embodiment described in relation to FIG. 9, the projection part 9 is pivotably connected with the first housing part 7 and has an abrasive edge 10 in the first end 18. The projection part 9 is movable between a retracted position and a projected position in relation to the tool housing 6.

For rotating a rotatable cutting head 110, the downhole tubing intervention tool/downhole tool 1 comprises the rotatable shaft 12 rotated by a motor 20. The rotatable shaft 12 extends through the second housing part 8 and the first housing part 7, and in the first housing part 7, the rotatable shaft 12 provides a rotational input for a gearing assembly 532. For moving the projection part 9 between the retracted position and the projected position, the downhole tubing intervention tool/downhole tool 1 comprises a projection part activation assembly 111. The projection part activation assembly 111 comprises a piston housing 113 arranged in the first housing part 7 and comprising a piston chamber 114. A piston member 115 is arranged inside the piston chamber 114 and engages with an activation element 55 adapted to move the projection part 9 between the retracted position and the projected position. The piston member 115 is movable in a longitudinal direction of the tool and has a first piston face 116. Hydraulic fluid from the hydraulic pump 21 is pumped through a first fluid channel 118 into the piston chamber 114, applying hydraulic pressure on the first piston face 116. The piston moves in a first direction, and the piston member 115 applies a projecting force on the projection part 9. When the piston member 115 moves in the first direction, a spring member 140 abutting the activation element 55 is compressed. To retract the projection part 9 from the projected position (indicated by dotted lines), the supply of hydraulic fluid to the piston chamber 114 is terminated, and the spring member 140 forces the piston member 115 in a second direction opposite the first direction along the longitudinal direction L of the tool.

The spring member 140 may also be arranged inside the piston housing 113, thereby providing a retraction force of the projection part 9. When the piston member 115 moves in the first direction, the spring member 140 is compressed in the piston housing 113. To retract the projection part 9 from the projected position, the supply of hydraulic fluid to the piston chamber 114 is terminated, and the spring member 140 forces the piston member 115 in a second direction opposite the first direction along the longitudinal direction L of the tool.

In FIG. 10, the activation member/element 55 has the shape of an L-profile of which a first end 551 engages with a recess 561 in the outer sleeve of the projection part 9. The first end 551 of the activation member 55 is rounded in order for the recess 561 to be able to rotate around the first end 551 when the projection part 9 is moved into the projected position. It is envisaged by the skilled person that the projection part activation assembly 111 may be constructed using various other principles without departing from the invention. The activation member 55 may be adapted to move the projection part 9 from the retracted position to the extended position only. The spring member 140 may thereby be adapted to provide a retraction force directly to the projection part 9 to move the projection part 9 from the projected position to the retracted position.

FIG. 11 shows a cross-sectional view of an alternative anchor section 22 to the anchor section shown in FIGS. 1A and B or FIG. 8 for anchoring the second housing part 8 of the tool housing 6 in relation to the casing 2. The anchor system/section 22 comprises a plurality of anchors 221 which may be extended from the second housing part 8, as shown in FIG. 11. Each of the anchors 221 comprises two anchor arms 222, 223 pivotally connected at a first pivot point 230; a first anchor arm 222 pivotally connected to the second housing part 8 at a second pivot point 231 and a second anchor arm 223 pivotally connected to a piston sleeve 224 provided in a bore 226 in the second housing part 8, around the rotatable shaft 12. The piston sleeve 224 is thus an annular piston. The piston sleeve 224 is under the influence of a spring member 225, providing a fail-safe system ensuring that the plurality of anchors 221 are retracted in order to be able to retrieve the tool in the event that power is lost, or any other breakdown occurs. In FIG. 11, the anchors 221 are extended, and the spring member 225 is compressed by the piston sleeve 224 being forced in a first direction away from the projection part 9 by a hydraulic fluid supplied under pressure to a piston chamber 228, thereby acting on a piston face 227 of the piston sleeve 224. When the supply of hydraulic fluid is terminated, the pressure on the piston face 227 decreases, and the spring member 225 displaces the piston sleeve 224 in a second direction opposite the first direction, whereby the anchors 221 are retracted.

The hydraulic fluid for displacing the piston sleeve 224 is supplied by a hydraulic system separate from the hydraulic system used for supplying the hydraulic pressure for moving the projection part 9 between the retracted position and the projected position. By using two separate hydraulic systems, the projection part 9 and the anchors 221 may be operated independently of one another. For example, the projection part 9 may be retracted if problems occur during the cutting operation, without affecting the position of the tool in the well. Thus, the tool remains stationary in the well, and the projection part 9 may be projected once again to continue the interrupted cutting procedure. Had the tool not been kept stationary during retraction of the projection part 9, it would be difficult to determine the position of the initiated cutting, and the cutting procedure would have to start all over again at a new position. When having to start all over, the abrasive edge or bits 10 on the projection part 9 may have been abraded too much for the tool to be able to cut through the casing 2 at the new position, and the tool may therefore have to be retracted from the well to replace the segment of the projection part 9 in order to be able to cut all the way through the casing 2.

To ensure that the tool does not remain anchored in the well due to a power loss or malfunction of one of the hydraulic systems, the hydraulic system of the anchor section 22 comprises a timer for controlling the supply of hydraulic fluid to the piston chamber 228. When the projection part 9 is retracted, the timer registers/records the time elapsed. Depending on operation-specific parameters, the timer may be set to retract the anchors 221 at any time after retraction of the projection part 9, preferably between 15 and 180 minutes, and more preferably between 30 and 60 minutes after retraction of the projection part 9. When the set time has lapsed, the timer activates a valve which controls the pressure in the piston chamber 228. As the valve is activated, the pressure in the piston chamber 228 drops, and the piston member 115 displaces the piston sleeve 224 to retract the anchors 221. The valve control comprises a battery, and activation of the valve may be powered by the battery if the power to the tool is cut. The anchor arm 222 has an end surface facing the inner face of the casing 2 when being in the projected position, which is serrated to improve the ability of the anchor arm 222 to engage with the inner face of the casing 2. The tool comprises a second pump for driving the separate hydraulic system to activate the anchor system 22. Thus, the rotatable shaft 12 around which the piston sleeve 224 extends may have a fluid channel for supplying fluid to the projection of the projection part 9.

The downhole system 100, shown in FIGS. 1A and 1B, comprises a first well tubular metal structure, a second well tubular metal structure and the abovementioned downhole tubing intervention tool/downhole tool for arrangement in the downhole system. In FIG. 1B, a control line/hydraulic tube 38 is arranged between the two well tubular metal structures.

In FIG. 12A, the downhole tubing intervention tool or downhole tool 1 is arranged in a single-cased well having a first well tubular metal structure and the downhole tool.

The invention also relates to a downhole method for providing isolation at a predetermined position in an existing well 101 having the top 51 and the first well tubular metal structure 2 arranged in a wellbore 3, the first well tubular metal structure having the longitudinal extension L. The downhole method comprises inserting the downhole tubing intervention tool/downhole tool 1 comprising the bit 10 on the projection part 9 in the first well tubular metal structure 2, positioning the downhole tubing intervention tool/downhole tool 1 opposite the predetermined position and separating a first section/upper part 4 of the first well tubular metal structure 2 from a second section/lower part 5 of the first well tubular metal structure 2 by machining into and along a circumference of the first well tubular metal structure 2. Then as shown in FIG. 12B, the downhole tubing intervention tool/downhole tool 1 in an inactivated position is moved a predetermined distance d along the longitudinal extension in the first section 4 of the first well tubular metal structure 2 to a second position above the predetermined position, and a first part 4A of the first section 4 of the first well tubular metal structure 2 is separated from a second part 4B of the first section 4 of the first well tubular metal structure 2 by machining into and along a circumference of the first well tubular metal structure 2, providing an uncased opening 112 between the second part of the first section and the second section and thus providing access to the wellbore wall, creating optimal conditions for providing a regulatorily compliant cement plug for safe Plug and Abandonment. The first part 4A is left in the well. The downhole tool (machining) is stopped or deactivated prior to moving the downhole tool a predetermined distance along the longitudinal extension above the predetermined position. Then, the downhole tubing intervention tool/downhole tool 1 is moved again in a non-machining condition of the tool, and the second part 4B of the first section 4 of the first well tubular metal structure 2 is separated from a third part 4C of the first section 4 of the first well tubular metal structure 2, increasing the uncased opening 112. This method is repeated until a plurality of parts 4A-E have been separated from the remaining first section along a distance dx as shown in FIG. 12C, leaving plurality of parts 4A-E in the well.

As shown in FIG. 12D, the downhole method further comprises inserting a barrier 220, 301, such as an annular barrier 220 (shown in FIGS. 16A and 16B) or a plug 301, between the first section and the second section. Different plug designs are shown in FIGS. 13-15. Then the barrier is expanded for providing isolation at the predetermined position isolation an upper part 3A of the wellbore from a lower part 3B, as shown in FIG. 12D. Subsequently, as shown in FIG. 12E, cement 401 is poured onto the barrier 301 and through the uncased opening 112.

In FIG. 16A, the barrier is an annular barrier 220 being inserted by another downhole tool 1B. The annular barrier 220 comprises a tubular metal part 52, an expandable metal sleeve 53 connected with and surrounding the tubular metal part 52, providing an annular space 54 between the well tubular metal structure 2 and the expandable metal sleeve 53, the tubular metal part 52 having an expansion opening 56. The downhole tubing intervention tool/downhole tool 1 has a pump for pumping fluid into the annular space in order to expand the expandable metal sleeve 53. Then the tool is retracted, leaving the annular barrier 220 in the well, as shown in FIG. 16B. Even not shown the expandable metal sleeve of the annular barrier may be expanded around the left parts in the well.

FIG. 13 shows an abandonment plug 301 for Plug and Abandonment of a well. The abandonment plug 301 comprises a first end part 303 being closed and forming a bottom of the plug and a second end part 304 being tubular and having a groove 305 in its inner face 306. The second end part 304 is closest to the top of the well. The abandonment plug 301 further comprises an expandable metal sleeve 307 arranged between the end parts so that the expandable metal sleeve 307 is the only element connecting the first end part 303 and the second end part 304. The end parts 303, 304 are more rigid than the expandable metal sleeve 307 so that when a pressurised fluid is applied, the expandable metal sleeve 307 is radially expanded to permanently deform and conform to the borehole wall or to a well tubular metal structure, thereby forming a plug therein. The abandonment plug 301 furthermore comprises a unit (not shown) which is releasably connected within a second tubular end part. The unit comprises at least one radially projectable fastening element, a unit sleeve and a piston movable within the unit sleeve. The piston moves between a first position in which the piston forces a radially projectable fastening element radially outwards in engagement with the groove 305 and a second position in which the piston is offset in relation to the radially projectable fastening element, allowing the radially projectable fastening element to move radially inwards.

The abandonment plug 301 has a length of less than 5 metres, and preferably less than 3 metres. The abandonment plug 301 is typically arranged in a well tubular metal structure for stopping cement being poured into the well to provide a cement plug being 30-100 metres long.

As can be seen in FIG. 13, the expandable metal sleeve 307 is mounted end-to-end to the first and second end parts 303, 304 so that the expandable metal sleeve 307 is the only element connecting the first end part 303 and the second end part 304. At this stage, the unit has been released and pulled out, and the plug is ready for being filled with cement, and cement is placed above the abandonment plug 301. The expandable metal sleeve 307 has circumferential projections 314 and a sealing element 315 arranged between two projections to better seal against the borehole or within a well tubular metal structure.

The abandonment plug 301 is typically connected to a workover pipe, a drill pipe (a drill pipe string), coiled tubing or similar disconnectable tubing in order to provide pressurised fluid from the surface to expand the abandonment plug 301 and disconnect when the plug has been set. In another embodiment, the abandonment plug 301 is connected to a wireline tool, as shown in FIG. 12D, having a pump 39 for providing the pressurised fluid.

The abandonment plug 301 of FIG. 14 has an opening 323 in the first end part 303 for receiving a wiper dart 324 (or a ball) to close the first end part 303. By having an opening 323 in the first end part 303, cement can be injected below the plug 301 before the expandable metal sleeve 307 is expanded and the plug 301 is set. After the cement has been applied through the opening 323, the wiper dart 324 is dropped and seated in the first end part 303, as shown in FIG. 14, closing the first end part 303. Subsequently, cement can be applied through a drill pipe string or a drill pipe connected to the plug 301, and the expandable metal sleeve 307 is expanded, as shown in FIG. 12E. The plug 301 can thus be set in the middle of a cemented zone to contribute to the curing process in the intended position as this plug 301 can be applied with cement below, in and above the plug. Sealing means 337 are provided in different places for ensuring a sufficient seal between the moving parts of the abandonment plug 301.

As shown in FIG. 15, the first end part 303 and the second end part may also be connected as shown in FIG. 15 so that there is a base part 352 underneath the expandable metal sleeve 307. By having such base part 352 connecting the first end part 303 and the second end part 304, the abandonment plug 301 is significantly stronger in the longitudinal extension of the plug 301. The base part 352 has an opening 356 for letting fluid into an annular space between the base part 352 and the expandable metal sleeve 307.

The downhole method according to the invention is thus very useful when a control line or hydraulic tube 38 extends along the longitudinal extension outside the first well tubular metal structure 2, and then the step of separating the first section 4 of the first well tubular metal structure 2 from the second section 5 further comprises separating the first part 38A of the control line or hydraulic tube 38 from the second part 38B of the control line or hydraulic tube 38. This is performed as the projection part 9 is capable of projecting further radially outwards during the machining process and thus when needed. Thus, the first part 38A of the control line or hydraulic tube 38 is separated from the second part 38B of the control line or hydraulic tube 38 by projecting the bit 10 on the projection part 9 further outwards in the radial direction R.

The downhole method according to the invention is thus very useful when a second well tubular metal structure 2B is arranged circumferentially to the first well tubular metal structure 2, as shown in FIG. 1A, and then the step of separating the first section 4 of the first well tubular metal structure 2 from the second section 5 further comprises separating a first section 4.1B of the second well tubular metal structure 2B from a second section 5B of the second well tubular metal structure 2B by machining into and along a circumference of the second well tubular metal structure 2B. The first section 4.1B of the second well tubular metal structure 2B is separated from the second section 5B of the second well tubular metal structure 2B by projecting the bit 10 on the projectable element further outwards in the radial direction R. This process is repeated when the tool is moved in an inactivated condition to the new position when separating a new part from the first section 4 of the first well tubular metal structure 2. This is due to the projection parts 9 being projectable by means of hydraulics, and thus the projection part 9 is capable of projecting further radially outwards during the machining process when needed.

As shown in FIG. 1B the downhole method according to the invention is thus very useful when the second well tubular metal structure 2B is arranged circumferentially to the first well tubular metal structure 2 and the control line or hydraulic tube 38 is arranged between the first well tubular metal structure 2 and the second well tubular metal structure 2B. Then the step of separating a first section 4 of the first well tubular metal structure from a second section 5 further comprises separating a first section 4.1B of the second well tubular metal structure 2B from a second section 5B of the second well tubular metal structure 2B by machining into and along a circumference of the second well tubular metal structure 2B.

Even though only shown as a second well tubular metal structure 2B, a sleeve could be arranged circumferentially to the first well tubular metal structure 2 in a similar manner, and the step of separating a first section 4 of the first well tubular metal structure 2 from a second section 5 further comprises separating a first section of the sleeve from a second section 5 section of the sleeve by projecting the projection part 9 further radially outwards so that the bit 10/first segment 25 cuts or grinds into the sleeve.

The downhole system 100 for performing the abovementioned downhole method to provide zonal isolation at a predetermined position in the borehole 3 or another well tubular metal structure 2 having a longitudinal extension in an existing well comprises the first well tubular metal structure 2 arranged in the borehole 3, a downhole tool 1 inserted in the first well tubular metal structure and positioned opposite the predetermined position for separating several first parts of the first section 4 of the first well tubular metal structure 2 from the second section 5 of the first well tubular metal structure 2 by machining into and along a circumference of the first well tubular metal structure 2, providing an uncased opening and the barrier 220, 301, such as a plug, arranged in the uncased opening between the first section 4 and the second section 5 for providing zonal isolation at the predetermined position before cement is poured down into the first section 25 of the first well tubular metal structure 2.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

In the event that the tool is not submergible all the way into the casing 2, a downhole tractor can be used to push the tool all the way into position in the well.

The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. A downhole method for preparing and/or providing isolation at a predetermined position in an existing well having a top and a first well tubular metal structure arranged in a wellbore, the first well tubular metal structure having a longitudinal extension, comprising:

inserting a downhole tool comprising a bit on a projection part in the first well tubular metal structure, positioning the downhole tool at the predetermined position, separating a first section being an upper part of the first well tubular metal structure from a second section being a lower part of the first well tubular metal structure by machining into and along a circumference of the first well tubular metal structure, moving the downhole tool a predetermined distance upwards along the longitudinal extension in the first section of the first well tubular metal structure to a second position above the predetermined position, and separating a first part of the first section of the first well tubular metal structure from a second part of the first section of the first well tubular metal structure by machining into and along a circumference of the first well tubular metal structure, providing an uncased opening between the second part of the first section and the second section.

2. The downhole method according to claim 1, further comprising permanently leaving a substantially in tact portion of the first part of the first section of the first well tubular metal structure in the well.

3. The downhole method according to claim 1, further comprising:

inserting a barrier in the uncased opening between the first section and the second section for providing isolation in the wellbore isolating an upper part of the wellbore from a lower part of the wellbore.

4. The downhole method according to claim 3, further comprising:

expanding the barrier to isolate the upper part from the lower part.

5. The downhole method according to claim 3, further comprising pouring cement in the upper part onto the barrier and through the uncased opening.

6. The downhole method according to claim 1, wherein separating the first section from the second section comprises machining part of the first well tubular metal structure over the predetermined distance along the longitudinal extension.

7. The downhole method according to claim 6, further comprising:

moving the downhole tool the predetermined distance along the longitudinal extension in the first section of the first well tubular metal structure to a third position above the second position, and separating another part of the first section of the first well tubular metal structure from a remaining part of the first section of the first well tubular metal structure by machining into and along a circumference of the first well tubular metal structure, increasing the uncased opening.

8. The downhole method according to claim 2, wherein the annular barrier comprises a tubular metal part, an expandable metal sleeve connected with and surrounding the tubular metal part, providing an annular space between the well tubular metal structure and the expandable metal sleeve, the tubular metal part having an expansion opening.

9. The downhole method according to claim 1, wherein a control line or hydraulic tube extends along the longitudinal extension outside the first well tubular metal structure, and the step of separating a first section of the first well tubular metal structure from a second section further comprises separating a first part of the control line or hydraulic tube from a second part of the control line or hydraulic tube.

10. The downhole method according to claim 1, wherein a second well tubular metal structure is arranged circumferentially to the first well tubular metal structure, and the step of separating the first section of the first well tubular metal structure from the second section further comprises separating a first section of the second well tubular metal structure from a second section of the second well tubular metal structure by machining into and along a circumference of the second well tubular metal structure.

11. The downhole method according to claim 9, wherein a second well tubular metal structure is arranged circumferentially to the first well tubular metal structure, and the control line or hydraulic tube is arranged between the first well tubular metal structure and the second well tubular metal structure, the step of separating a first section of the first well tubular metal structure from a second section further comprising separating a first section of the second well tubular metal structure from a second section of the second well tubular metal structure by machining into and along a circumference of the second well tubular metal structure.

12. The downhole method according to claim 9, wherein the first part of the control line or hydraulic tube is separated from the second part of the control line or hydraulic tube by projecting the bit on the projection part further outwards in a radial direction.

13. The downhole method according to claim 10, wherein the first section of the second well tubular metal structure is separated from the second section of the second well tubular metal structure by projecting the bit on the projectable element further outwards in the radial direction.

14. The downhole method according to claim 9, wherein a sleeve is arranged circumferentially to the first well tubular metal structure, and the step of separating a first section of the first well tubular metal structure from a second section further comprises separating a first section of the sleeve from a second section of the sleeve.

15. The downhole method according to claim 1, where the step of separating the first and/or second part is initiated to machining into and along a circumference of the first well tubular metal structure, and subsequently stopping the machining when the first and/or second part is separated.

16. The downhole method according to claim 1, wherein the machining is stopped or deactivated prior to moving the downhole tool a predetermined distance along the longitudinal extension above the predetermined position.

17. The downhole method according to claim 1, wherein the predetermined position is a first determined position, and where the separating a first part of the first section of the first well tubular metal structure from a second part of the first section of the first well tubular metal structure is performed at a second predetermined position, and where the downhole tool is inactive while being moved from the first predetermined position to the second predetermined position.

18. The downhole method according to claim 1, wherein the downhole tool is stopped when one portion of the well tubular structure has been separated from a second part of the well tubular structure.

* * * * *